US007469120B2

(12) United States Patent
Iwasaki et al.

(10) Patent No.: US 7,469,120 B2
(45) Date of Patent: Dec. 23, 2008

(54) IMAGE HEATING APPARATUS

(75) Inventors: Atsushi Iwasaki, Mishima (JP); Masafumi Maeda, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 313 days.

(21) Appl. No.: 11/531,893

(22) Filed: Sep. 14, 2006

(65) Prior Publication Data

US 2007/0065191 A1 Mar. 22, 2007

(30) Foreign Application Priority Data

Sep. 16, 2005 (JP) ..... 2005-271019

(51) Int. Cl.
*G03G 15/20* (2006.01)

(52) U.S. Cl. ..... 399/328; 399/329

(58) Field of Classification Search ..... 399/68, 399/330, 328, 329; 219/469–471, 216
See application file for complete search history.

(56) References Cited

U.S. PATENT DOCUMENTS

| | | | | |
|---|---|---|---|---|
| 5,115,278 | A * | 5/1992 | Maruta et al. | 399/329 |
| 5,148,226 | A * | 9/1992 | Setoriyama et al. | 399/329 |
| 5,149,941 | A | 9/1992 | Hirabayashi et al. | 219/216 |
| 5,300,997 | A | 4/1994 | Hirabayashi et al. | |
| 5,343,280 | A | 8/1994 | Hirabayashi et al. | |
| 5,525,775 | A | 6/1996 | Setoriyama et al. | 219/216 |
| 5,708,926 | A * | 1/1998 | Sagara et al. | 399/328 |
| 5,767,484 | A | 6/1998 | Hirabayashi et al. | 219/216 |
| 6,040,558 | A * | 3/2000 | Yamazaki | 219/216 |
| 6,895,208 | B2 * | 5/2005 | Nakatogawa et al. | 399/329 |
| 6,993,279 | B2 * | 1/2006 | Fukuzawa et al. | 399/329 |
| 7,193,181 | B2 | 3/2007 | Makihira et al. | 219/216 |
| 7,235,761 | B1 * | 6/2007 | Maul et al. | 219/216 |
| 7,242,895 | B2 | 7/2007 | Inada et al. | 399/328 |
| 7,317,893 | B2 * | 1/2008 | Maeda | 399/328 |
| 2005/0220507 | A1 * | 10/2005 | Uehara et al. | 399/329 |
| 2005/0280682 | A1 | 12/2005 | Kato et al. | 347/102 |
| 2006/0045589 | A1 | 3/2006 | Iwasaki et al. | 399/328 |
| 2006/0067750 | A1 | 3/2006 | Inoue et al. | 399/328 |
| 2006/0233575 | A1 * | 10/2006 | Uchida et al. | 399/329 |

FOREIGN PATENT DOCUMENTS

| | | |
|---|---|---|
| JP | S63-313182 | 12/1988 |
| JP | H04-044075 | 2/1992 |
| JP | H10-247026 | 9/1998 |
| JP | 2001-183930 | 7/2001 |
| JP | 2001-185328 | 7/2001 |

* cited by examiner

*Primary Examiner*—Susan S Lee
(74) *Attorney, Agent, or Firm*—Fitzpatrick, Cella, Harper & Scinto

(57) ABSTRACT

The image heating apparatus includes a cylindrical film, a heating member, and a drive roller, wherein a recording material bearing an image is heated while the recording material is bound and conveyed by the nip portion, and a distance between a contact position between the film and the recording material and a contact position which the film and the drive roller is equal to or less than 3.5 mm over a longitudinal direction of the nip portion, and a line formed by connecting positions at which said film is separated in the longitudinal direction of the nip portion from the recording material in the conveyance direction has an arc shape. Thus a heating process can be executed while suppressing creases in the recording material and a density loss in the image formed on the recording material.

5 Claims, 22 Drawing Sheets

IMAGE HEATING APPARATUS

BACKGROUND OF THE INVENTION

1. Field of the Invention

The present invention relates to an image heating apparatus, adapted for use as heat fixing device to be incorporated in an image forming apparatus such as a copying apparatus or a printer.

2. Description of the Related Art

As heat fixing device for an unfixed image for use in a copying apparatus or a laser beam printer, there has been proposed and commercialized a heating apparatus of film heating type, as proposed in Japanese Patent Application Laid-open Nos. S63-313182 and H04-044075.

In such film heating type device, a heat-resistant thin film (fixing film), constituting a rotary heating member, is contacted, by means of a pressurizing elastic rotary member (pressure roller), with a heating member and is conveyed in a sliding motion thereon. A material to be heated, namely a recording material bearing an unfixed image, is introduced into a pressure nip portion, formed by the heating member and the pressure roller through the fixing film, and is conveyed together with the fixing film. Thus, the unfixed image on the recording material is fixed, by the heat supplied from the heating member through the fixing film and the pressure in the pressure nip portion, as a permanent image on the recording material.

FIG. 18 is a schematic view showing the structure of a prior heat fixing device of the film heating type, having a maximum sheet passing width corresponding to A3 size. Also FIG. 19 is a perspective view of the heat fixing device shown in FIG. 18, in which the heating film is omitted.

The heat fixing device 10 is provided with a film unit 1, and a pressure roller 4 which forms a pressurized nip N with the film unit 1. The film unit 1 is principally provided with a heating member 3, a cylindrical film (fixing film) 2 driven in a rotary motion in contact with the heating member 3, and a film guide 5 serving as a support member for the film 2 and the heating member 3. The film unit 1 further includes a pressurizing stay 6 which presses the film guide 5 toward the pressure roller 4.

The heating member 3 is supported by pinching between the film guide 5 and the film 2. The fixing film 2 is formed by a heat-resistant film of a circular cross section, loosely fitted outside the film guide 5.

More specifically, the heating member 3 is formed by a plate-shaped ceramic base material of a low heat capacity, such as of alumina ($Al_2O_3$) or aluminum nitride (AlN). On a surface of such base material, a heat-generating pattern, formed for example by silver-palladium (Ag/Pd) or $Ta_2N$, and current-supplying electrode patterns of a low-resistance material, such as Ag, for supplying the heat-generating pattern with a current, are formed for example by screen printing. Also the surface bearing the heat-generating pattern is covered by a thin glass protective layer.

The pressure roller 4 forms a pressurized nip portion N in cooperation with the heating member 3 and through the film 2, and serves as outer film surface contact-drive means which drives the film 2 in rotation. The pressure roller 4 includes a metal core 4*a*, an elastic layer 4*b* formed for example by silicone rubber, and an outermost releasing layer 4*c*. The pressure roller 4 is pressed, under a predetermined pressure by unillustrated bearing/urging means, to the surface of the heating member 3, through the film 2. The pressure roller 4 is driven in rotation by an unillustrated motor, thus providing the film 2 with a conveying power by a friction between the pressure roller 4 and the external surface of the film 2.

As shown in FIG. 19, fixation flanges 8 are provided on longitudinal ends of the pressurizing stay 6. The fixation flanges serve to apply a pressure of an unillustrated pressurizing spring in a direction B, thereby transmitting the spring force to the pressurized nip portion N through the pressurizing stay 6, and to restrict the motion of the ends of the film 2 in the longitudinal direction thereof.

Now the functions of the heat fixing device 10 of the above-described structure will be explained.

Referring to FIG. 18, the heating member 3 generates heat by a current supply in the heat-generating pattern through the current-supplying electrode patterns, whereby the entire heating member shows a rapid temperature increase. The temperature increase in the heating member 3 is detected, as shown in FIG. 18, by a thermistor 7 provided as temperature detection means in contact with or in the proximity of the heating member 3, and is fed back to a current-supply control part 70 for the heating member. The current-supply control part 70 controls the current supply to the heat-generating pattern in such a manner that the temperature of the heating member, detected by the thermistor 7, is maintained at a substantially constant predetermined temperature (fixing temperature). Thus the heating member 3 is controlled at a predetermined fixing temperature.

Thus, there is reached a state where the heating member 3 has a predetermined temperature and the film 2, rotated by the pressure roller 4, has a constant peripheral rotation speed. In such state, a recording material P, bearing an unfixed image T, is conveyed from a transfer part of an unillustrated image forming apparatus and is introduced into the pressurized nip portion N formed by the heating member 3 and the pressure roller 4. Thus, the recording material P is conveyed through the pressurized nip portion N together with the film 2. Therefore, the heat of the heating member 3 is given to the recording material P through the film 2, whereby the unfixed visualized image (toner image) T on the recording material P is heat fixed onto a surface thereof. The recording material P, after passing the pressurized nip portion N, is separated from the surface of the film 2 and is further conveyed. A prior fixing apparatus shown in FIG. 18 is a center-reference apparatus, in which the recording material is conveyed in such a manner that a longitudinal center of the apparatus coincides with a center in the width direction of the recording material P.

In the film heat fixing device 10 of such type, particularly when recording materials P, having a width smaller than the length of the film 2 in the generating line thereof (such recording material being hereinafter called "small-sized sheet"), are conveyed in succession, the pressure roller 4 shows a thermal expansion in sheet non-passing areas in the longitudinal direction thereof. As a result, the fixing film conveying speed of the pressure roller 4 becomes larger in the sheet non-passing areas than the fixing film conveying speed of the pressure roller 4 in the sheet-passing area, and the fixing film 2 shows a difference in the rotation speed, along the longitudinal direction thereof, between the sheet non-passing areas and the sheet-passing area. As a result, there is generated a phenomenon that the fixing film 2, within an area thereof immediately before entering the nip portion N, becomes slack in a longitudinal central area (sheet-passing area). It is also already known that such slack in the film tends to generate creases in the paper. In order to prevent such creases in paper, a fixing apparatus is proposed as disclosed in Japanese Patent Application Laid-open No. H10-247026.

FIG. 20 is a schematic perspective view of a fixing apparatus disclosed in Japanese Patent Application Laid-open No.

H10-247026, seen from an upstream side of the conveyance direction, and omitting the fixing film.

In such fixing apparatus 10, protruding portions 11 are formed on the both ends in the longitudinal direction of a film guide 5, in a lateral face at the upstream side in the conveyance direction, and a protruding portion 12 is formed in a central part in the longitudinal direction of a pressurizing stay 6, on an upper face thereof.

FIGS. 21 and 22 are schematic views respectively showing through section in a central part in the longitudinal direction, and through section in an end part in the longitudinal direction, when the recording material P is conveyed in such fixing apparatus 10.

Separately from the pressurized nip N formed by the film 2 and the pressure roller 4, a contact area of the film 2 and the recording material P is defined as a contact nip M. Also a line, formed by connecting, along the longitudinal direction of the fixing apparatus, upstream ends of the contact nip M in the conveyance direction of the recording material, namely positions at which an arbitrary point on the recording material P starts to contact with the film 2, is defined as an entrance tangential line Ma. Also a line, formed by connecting, along the longitudinal direction of the fixing apparatus, downstream ends of the contact nip M in the conveyance direction of the recording material, namely positions at which an arbitrary point on the recording material P starts to be separated from the film 2, is defined as a separating tangential line Mb.

Referring to FIGS. 21 and 22, the cross sectional shape of the film 2 under running expands, at end portions in the longitudinal direction, in a direction K (toward upstream side in the conveyance of the recording material P) because of the protruding portions 11, and, at the central part of the longitudinal direction, in a direction J because of the protruding portion 12. By these functions, the pressurized nip N, the contact nip M and the running state of the film 2 assume a relationship as shown in a plan view in FIG. 23.

More specifically, in the proximity of the end portions in the longitudinal direction, the film surface extends farther in a direction toward the upstream side in the conveyance direction, and, in the proximity of the center in the longitudinal direction, the film surface becomes concave toward the pressurized nip N. Therefore, the entrance tangential line Ma assumes an approximately arc shape, whereby the recording material P tends to be stretched toward the outer sides in the longitudinal direction. This function suppresses generation of paper creases.

The fixing apparatus of this type is effective significantly against the paper creases, but may result in a drawback, particularly in case of passing a wide-sized paper (recording material of a width close to the film length along the generating line), of a decrease in the image density in the end portions of the recording material in the width direction thereof. Such drawback is induced by following reasons.

In the course of fixation conveyance of a wide-sized paper, the both end portions of the recording material tend to be curled upward (toward the film) by an outward tension on the recording material P by the paper creases preventing function, and the both end portions of the entrance tangential line Ma in the longitudinal direction are more stretched, than the proximity of the central portion, from the pressurized nip N toward the upstream side. Therefore, the unfixed image in both end portions comes into contact with the film, considerably in front of the pressurized nip N. The image may be easily perturbed because of these facts.

In consideration of such situation, a fixing apparatus is proposed as disclosed in Japanese Patent Application Laid-open No. 2001-183930. FIGS. 24 to 26 illustrate an example of such fixing apparatus 10, wherein FIG. 24 is a perspective view seen from the upstream side in the conveyance direction of the recording material P; FIG. 25 is a perspective view seen from the downstream side in the conveyance direction; and FIG. 26 is a plan view.

In such fixing apparatus 10, as shown in FIG. 24, protruding portions 11 are formed in areas inside by a certain amount from the both ends in the longitudinal direction of a film guide 5, at an entrance side therefore for the recording material, and a protruding portion 12 is formed in a central part in the longitudinal direction of a pressurizing stay 6, on an upper face thereof. Also, as shown in FIG. 25, a protruding portion 13 is formed in a central part in the longitudinal direction of the film guide 5 at the exit side of the recording material, and protruding parts 14 are formed on the fixation flanges 8 at the exit side of the recording material.

In case of conveying the recording material P by this fixing apparatus 10, the pressurized nip N, the contact nip M and the running shape of the film assume a relationship as shown in FIG. 26.

The fixing apparatus disclosed in Japanese Patent Application No. 2001-183930 has such a running state that the end portions of the entrance tangential line Ma, in the longitudinal direction thereof, do not protrude toward the upstream side, in comparison with the fixing apparatus disclosed in Japanese Patent Application No. 10-247026. In case of utilizing the fixing apparatus of Japanese Patent Application No. 2001-183930, the paper crease preventing function somewhat decreases in comparison with the fixing apparatus of Japanese Patent Application No. 10-247026, but the aforementioned density loss in the end portions is improved.

Also Japanese Patent Application No. 2001-185328 proposes a film unit structure, effective against the density loss in the end portions, by forming protruding portions in various parts of a film guide member, a pressurizing stay and fixation flanges.

However, even in such fixing apparatus, it is difficult to improve both the paper creases and the density loss (image perturbation) in the end portions, and there is observed a apparently trade-off relationship that an improvement in either property results in a deterioration in the other property.

Also in fixing apparatuses disclosed in Japanese Patent Application Laid-open Nos. 2001-183930 and 2001-185328, protruding portions are provided not only on the lateral face of the film guide at the upstream side in the conveyance direction, but also on the lateral face at the downstream side in the conveyance direction and on the upper face of the pressurizing stay, thereby significantly increasing the tension of the film. Therefore, the original drivability of the film is worsened, and, for example in a thin paper left standing in an environment of a high temperature and a high humidity, there are often experienced defects in fixation conveyance, such as an image perturbation and a sheet jamming, caused by a film slippage.

SUMMARY OF THE INVENTION

The present invention has been made in consideration of the aforementioned situation, and an object thereof is to provide an image heating apparatus capable of executing a heating process, while suppressing creases in a recording material and a density loss in an image formed on the recording material.

Another object of the present invention is to provide an image heating apparatus capable of executing a heating process while suppressing a tension applied to a cylindrical-shaped film.

A further object of the present invention is to provide an image heating apparatus including a cylindrical film, a heating member which contacts an internal periphery of the cylindrical film, and a drive roller which forms a nip portion with the heating member through the cylindrical film, wherein a recording material bearing an image is heated while the recording material is nipped and conveyed by the nip portion, and wherein a distance between a position at which the film starts contacting with the recording material in a conveyance direction of the recording material and a position at which the film starts contacting with the drive roller in the conveyance direction of the recording material is equal to or less than 3.5 mm over a longitudinal direction of the nip portion, and a line formed by connecting positions at which the film is separated from the recording material in the conveyance direction has a substantially arc shape which is most expanded to a downstream side of the conveyance direction near a recording material conveyance reference position in the longitudinal direction of the nip portion.

A still further object of the present invention will become apparent from the following description of exemplary embodiments (with reference to the attached drawings).

DESCRIPTION OF THE EMBODIMENTS

In the following, the heating apparatus and the image forming apparatus of the present invention will be explained in further details, with reference to the accompanying drawings.

Embodiment 1

Figure 1:
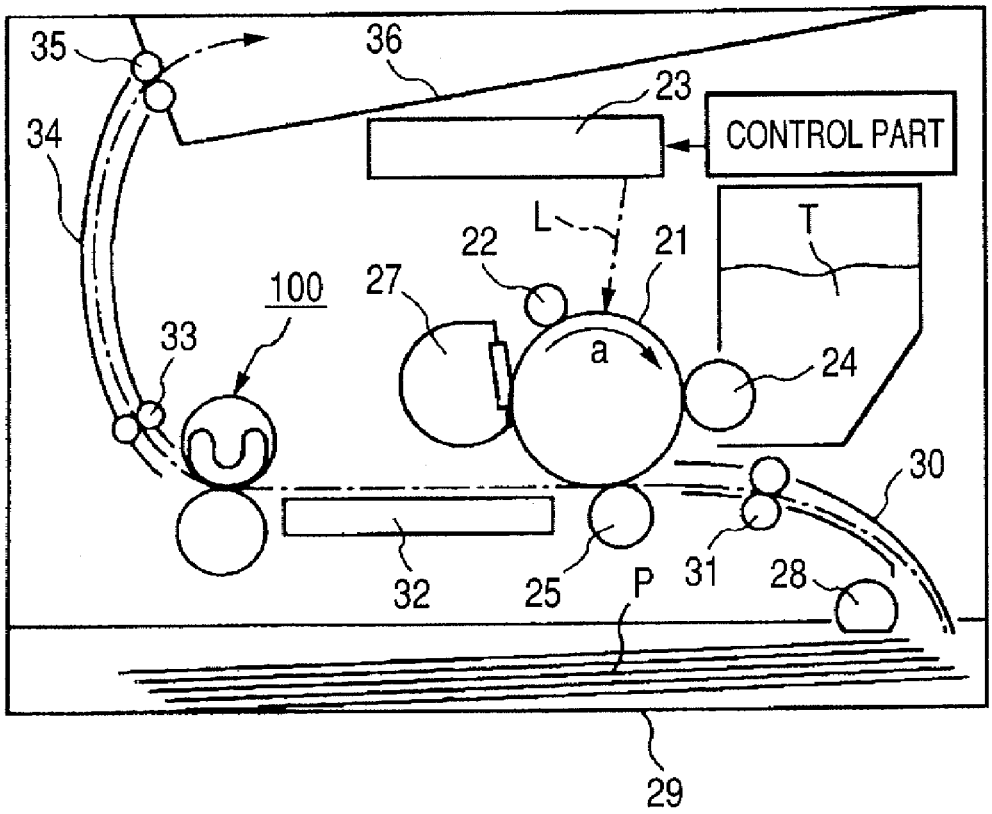
FIG. 1 is a schematic view of an image forming apparatus, incorporating an image heating apparatus of the present invention.

FIG. 1 is a schematic view showing an image forming apparatus, incorporating an image heating apparatus of the present invention. In the present embodiment, the image forming apparatus is a laser beam printer utilizing an electrophotographic process.

Entire Structure of Image Forming Apparatus

The image forming apparatus shown in FIG. 1 is equipped, as an image bearing member, an electrophotographic photosensitive member 21 of a rotary drum shape (hereinafter called photosensitive drum). The photosensitive drum 21 is rotated clockwise as indicated by an arrow a, with a predetermined peripheral speed (process speed). The photosensitive drum 21 has a structure, having a layer of a photosensitive material such as OPC, amorphous Se or amorphous Si, on an external periphery of a conductive substrate of cylindrical (drum) shape, formed for example by aluminum or nickel. On the surface of the photosensitive drum 21, a visualized image (toner image) is formed by image forming means provided therearound. Such toner image is transferred onto a recording material P.

More specifically, the photosensitive drum 21 is uniformly charged, in the course of rotation thereof, with predetermined polarity and potential by a charging roller 22 serving as charging means.

On the other hand, a laser beam scanner 23, serving as exposure means, outputs a laser beam, subjected to a modulation control (on/off control) according to time-sequential electrical digital pixel signals of desired image information. The outputted laser beam irradiates, as a scanning exposure light L, the uniformly charged surface of the rotary photosensitive drum 21. Thus an electrostatic latent image of the desired image information is formed on the surface of the rotary photosensitive drum.

The latent image on the photosensitive drum 21 is rendered visible as a toner image, by a development with toner T in a developing apparatus 24. The development may be executed by a jumping development, a two-component development or a feed development, and there is often utilized a combination of an imagewise exposure and a reversal development.

On the other hand, a sheet-feed roller 28 is activated to advance one by one recording materials P, stored in a sheet cassette 29. The recording material P is fed, through a sheet path having guides 30 and registration rollers 31, at a predetermined timing, to a transfer nip portion, which is a pressurized contact portion of the photosensitive drum 21 and a transfer roller 25 serving as transfer means. The toner image on the surface of the photosensitive drum 21 is transferred in successive manner onto the surface of the recording material P.

The recording material P, exiting from the transfer nip portion, is separated in succession from the surface of the rotary photosensitive drum 21, and is introduced, by a conveying apparatus 32, into heat fixing device (image heating apparatus) 100, thereby being subjected to a heat fixing process of the toner image. The heat fixing device 100 will be explained later.

The recording material P, exiting from the heat fixing device 100, passes through a sheet path including conveying rollers 33, guides 34 and discharge rollers 35, and is outputted as a print onto a sheet discharge tray 36.

The surface of the rotary photosensitive drum, after separation of the recording material, is cleaned by a process, by a cleaning apparatus 27, for removing deposited substances such as a transfer residual toner, and is used again for image formation.

Heat Fixing Device

Figure 2:
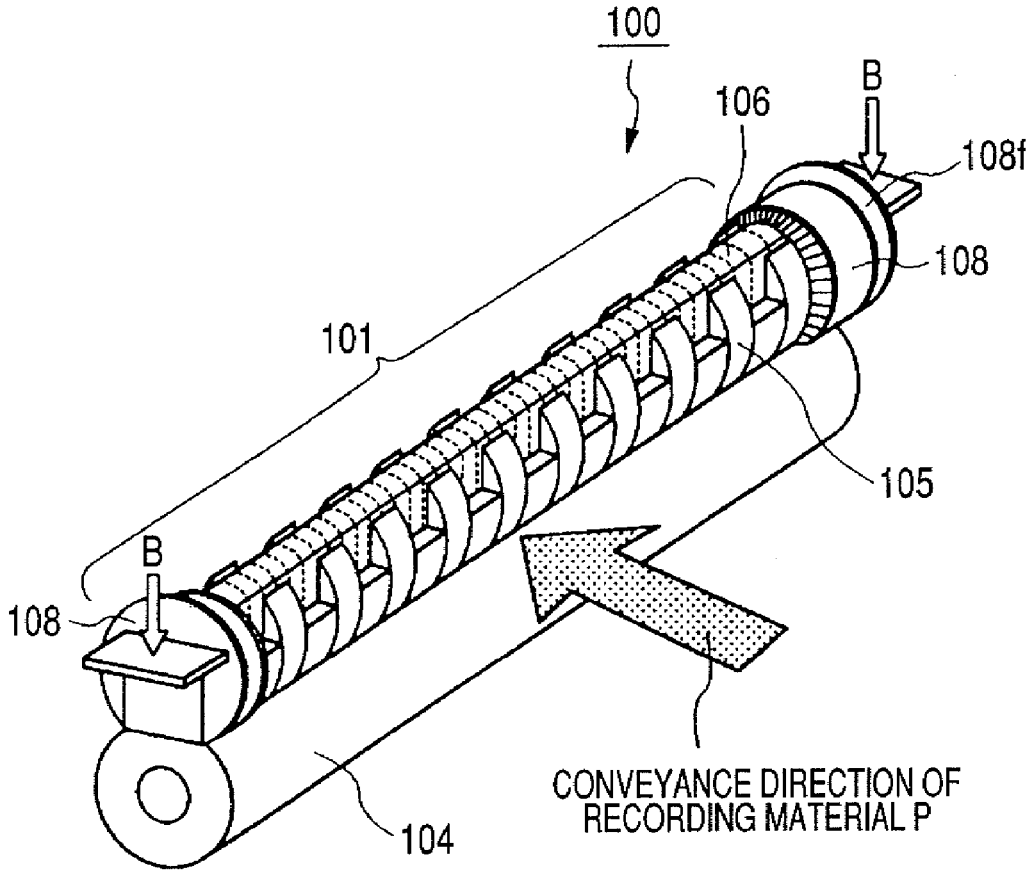
FIG. 2 is a perspective view showing a schematic structure of an embodiment of heat fixing device of the present invention, seen from an upstream side in the conveyance direction of a recording material.
Figure 3:
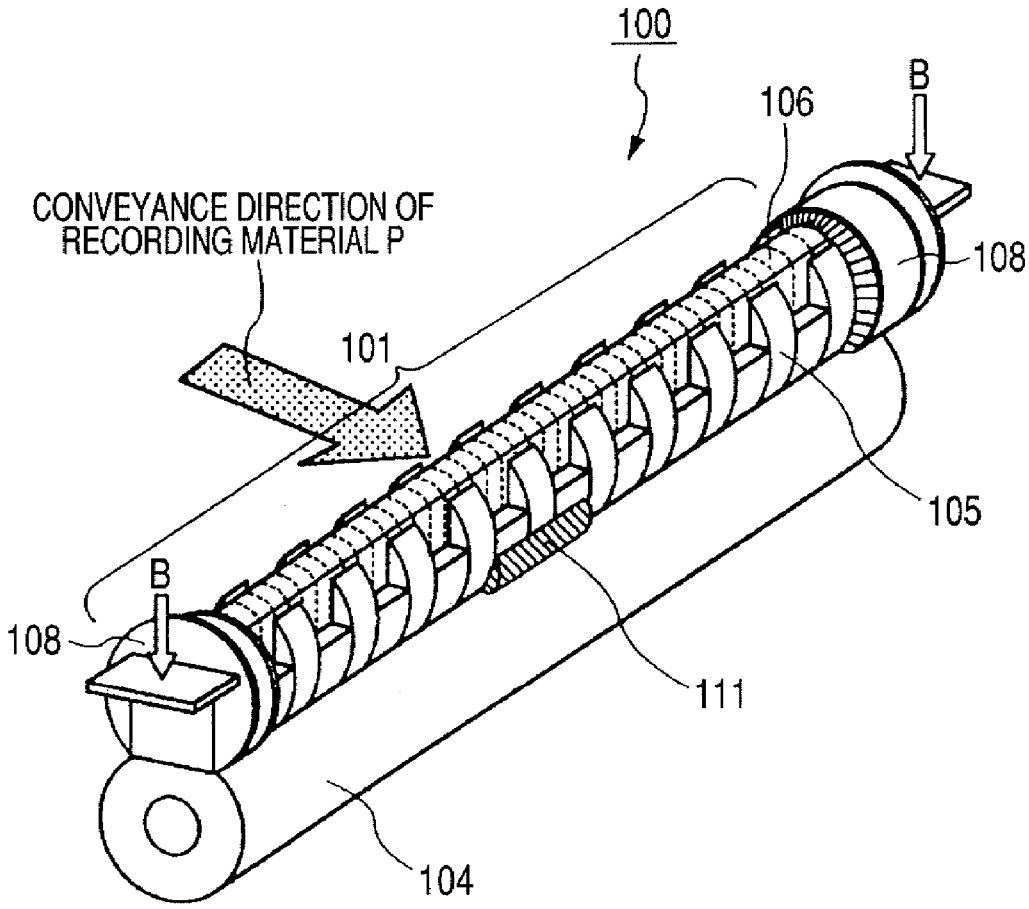
FIG. 3 is a perspective view showing a schematic structure of an embodiment of the heat fixing device of the present invention, seen from a downstream side in the conveyance direction of a recording material.
Figure 4:
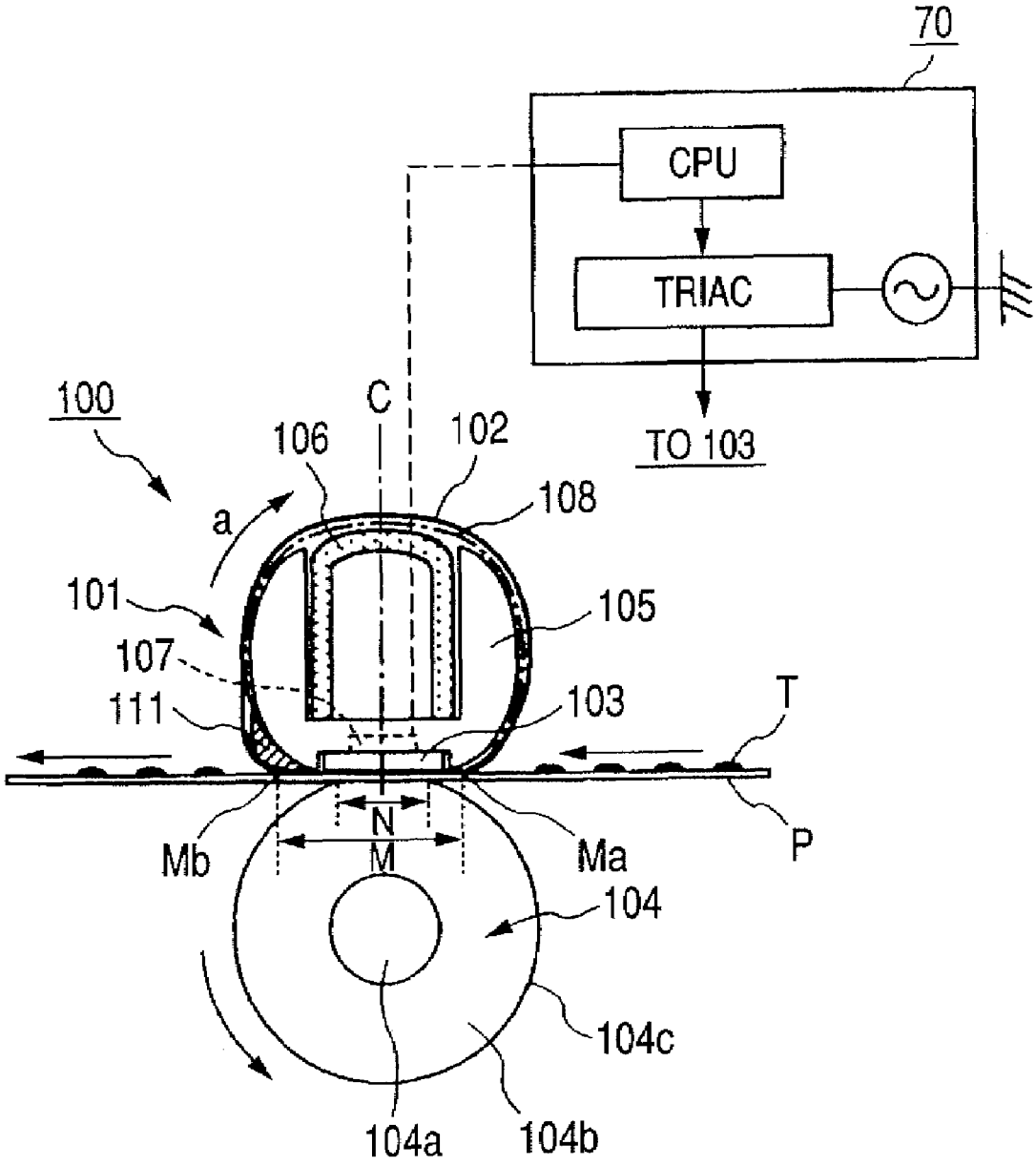
FIG. 4 is a cross-sectional view showing a schematic structure of an embodiment of the heat fixing device of the present invention.
Figure 5:
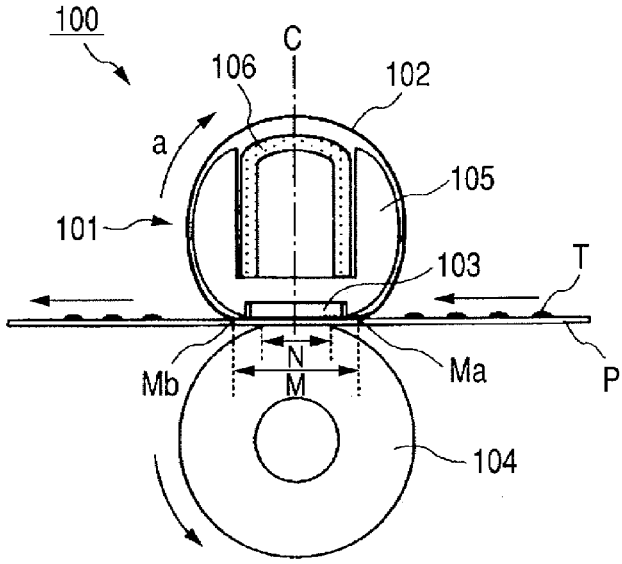
FIG. 5 is a cross-sectional view showing a schematic structure, in an end portion in a longitudinal direction, of an embodiment of the heat fixing device of the present invention.

In the following, heat fixing device 100, constituting an embodiment of the image heating apparatus of the present invention, will be explained with reference to FIGS. 2 to 5. FIG. 2 is a perspective view showing a schematic structure of the heat fixing device, seen from an upstream side in the conveyance direction of a recording material P, and FIG. 3 is a perspective view showing a schematic structure of the heat fixing device, seen from a downstream side in the conveyance direction of the recording material P. In the heat fixing device 100, a fixing film 102 (cf. FIG. 4) of the heat fixing device 100 is omitted. FIG. 4 is a schematic cross-sectional view of a central part within a longitudinal direction, which is perpendicular to the conveyance direction of the recording material P, and FIG. 5 is a schematic cross-sectional view of an end portion within the longitudinal direction.

The heat fixing device 100 of the present embodiment has a maximum sheet passing size corresponding to A3 size, and a recording material conveyance reference position is at the center within the longitudinal direction.

The heat fixing device 100 of the present embodiment is of a film heating type, and includes, as in the prior structure, a film unit 101 and a pressure roller (drive roller) 104 which forms a pressurized nip N in cooperation with the film unit 101. The film unit 101 principally includes a heating member 103, a cylindrical film (fixing film) 102 which moves in rotation in contact with the heating member 103, and a film guide (support member for heating member) 105, serving as a support member for the film 102 and the heating member 103. The film unit 101 further includes a pressurizing stay 106, which presses the film guide 105 toward the pressurized roller 104.

The heating member 103 is supported between the film guide 105 and the film 102. The fixing film 102 is a heat-resistant film having a circular cross section, loosely fitted outside the film guide 105.

As shown in FIGS. 2 and 3, there are provided, on both end portions of the pressurizing stay 106 in the longitudinal direction thereof, fixation flanges 108 having approximately cylindrical peripheral surfaces, on which the end portions of the fixing film 102 in the longitudinal direction thereof are fitted and slide. In the present embodiment, one of the fixation flanges 108, positioned at the right-hand side in FIGS. 2 and 3, has a brim portion **108*f* of an external shape made larger than the cylindrical periphery in the radial direction, in an area positioned above a pressure roller 104. However, such structure is not restrictive, and the brim portion 108*f* may be provided on both flanges 108**.

On the fixation flange 108, a pressure of an unillustrated pressurizing spring is applied in a direction indicated by an arrow B. Thus, a force is applied to the pressurized nip portion N, through the pressurizing stay 106, the film guide 105 and the heating member 103. Also the brim portion **108*f* of the fixation flange 108 has a function of limiting the displacement of the film 102** toward the end portion in the longitudinal direction.

The cylindrical heat-resistant film 102 is formed by a cylinder of a thin film, which is constituted for example of a base layer of polyimide or the like of a thickness of from about 30 to 100 μm, and a coating for example of PFA or PTFE is applied, through a primer layer, on the base layer, thereby ensuring a releasing property for the toner. Also between the internal surface of the film 102 and the heating member 103, an unillustrated sliding grease is coated to ensure the slidability of the film 102.

The heating member 103 is formed by a plate-shaped ceramic base material of a low heat capacity, such as of alumina ($Al_2O_3$) or aluminum nitride (AlN). On a surface of such base material, a heat-generating pattern, formed for example by silver-palladium (Ag/Pd) or $Ta_2N$, and current-supplying electrode patterns of a low-resistance material, such as Ag, for supplying the heat-generating pattern with a current, are formed for example by screen printing. Also the surface bearing the heat-generating pattern is covered by a thin glass protective layer.

The pressure roller 104 forms a pressurized nip portion N in cooperation with the heating member 103 and through the film 102, and serves as a drive roller which drives the film 102 in rotation. The pressure roller 104 includes a metal core **104*a*, an elastic layer 104*b* formed for example by silicone rubber, and an outermost releasing layer 104*c*. The metal core 104*a* is fixed, by unillustrated bearings, to a frame member of the fixing apparatus. Also the pressure roller 104 receives the pressing powers by the aforementioned pressurizing springs, whereby the heating member 103 and the pressure roller 104 constitute, through the film 102, a pressurized nip portion N. The pressure roller 104 is driven in rotation by an unillustrated motor, whereby the film 102 rotates by a friction between the pressure roller 104 and the external surface of the film 102**.

The film guide 105 is formed by a highly heat-resistant resin having a heat insulating property, a high heat resistance and a rigidity, such as polyphenylene sulfide (PPS), polyamidimide (PAI), polyimide (PI), polyether ether ketone (PEEK) or a liquid crystal polymer. It may also be formed by a composite material of such resin and ceramics, a metal or glass.

In the following, functions of the heat fixing device 100 of the above-described structure will be explained.

By the rotation of the pressure roller 104, the film 102 rotates, in a direction indicated by an arrow a, outside the film guide 105 which supports the heating member 103.

The heating member 103 generates heat by a current supply in the heat-generating pattern through the current-supplying electrode patterns, whereby the entire heating member shows a rapid temperature increase. The temperature increase in the heating member 103 is detected by a thermistor 107 provided as temperature detection means in contact with or in the proximity of the heating member 103, and is fed back to a current-supply control part 70 for the heating member. The current-supply control part 70 controls the current supply to the heat-generating pattern in such a manner that the temperature of the heating member, detected by the thermistor 107, is maintained at a substantially constant predetermined temperature (fixing temperature). Thus the heating member 103 is controlled at a predetermined fixing temperature.

Thus, there is reached a state where the heating member 103 is heated to a predetermined temperature and the film 102, rotated by the pressure roller 104, has a constant peripheral rotation speed. In such state, a recording material P to be subjected to an image fixation is conveyed from a transfer part 25 of the image forming apparatus and is introduced into the pressurized nip portion N formed by the heating member 103 and the pressure roller 104. Thus, the recording material P is conveyed through the pressurized nip portion N together with the film 102. The fixing apparatus of the present embodiment conveys the recording material, in such a manner that a center of the recording material P in the width direction thereof (direction perpendicular to the conveyance direction) coincides with the center of the fixing apparatus in the longitudinal direction thereof (center reference).

Therefore, the heat of the heating member 103 is given to the recording material P through the film 102, whereby the unfixed visualized image (toner image) T on the recording material P is heat fixed onto a surface thereof. Then the recording material P, after passing the pressurized nip portion N, is separated from the surface of the film 102.

The recording material P, separated from the film 102 by a curvature, passes through the sheet path having conveying rollers 33, guides 34 and sheet discharge rollers 35 as described above, and is discharged on a sheet discharge tray 36.

As defined in the description of the background technology, M in FIG. 4 indicates a contact nip, which is a contact area of the film 102 and the recording material P. Also a line, formed by connecting, along the longitudinal direction, upstream ends of the contact nip M, namely positions at which an arbitrary point on the recording material P starts to contact with the film 102, is defined as an entrance tangential line Ma. Also a line, formed by connecting, along the longitudinal direction, downstream ends of the contact nip M, namely positions at which an arbitrary point on the recording material P starts to be separated from the film 102, is defined as a separating tangential line Mb.

Figure 6:
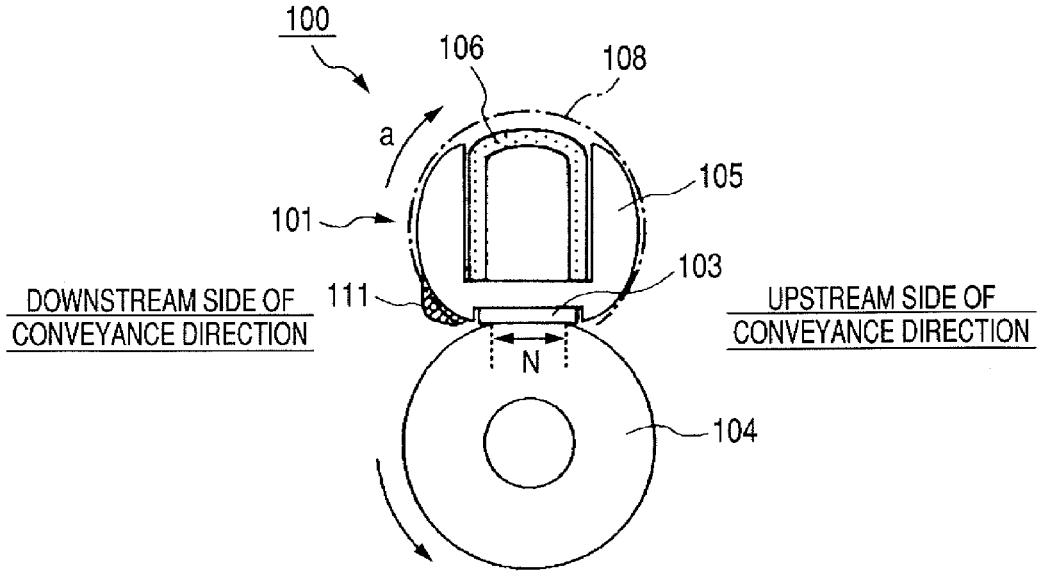
FIG. 6 is a cross-sectional view showing a schematic structure, in a central portion within a longitudinal direction, of an embodiment of the heat fixing device of the present invention, also showing a sliding face of a fixation flange.

In the following, the structure of the film unit 101 in the heat fixing device 100 of the present embodiment and a film running state based thereon will be explained with reference to FIG. 6. FIG. 6 is a schematic cross-sectional view of a central part of the heat fixing device 100 within the longitudinal direction thereof, from which the fixing film 102 is omitted and with which a sliding face of the fixation flange 108 is illustrated in an overlapping manner.

At first, in the upstream side of nip portion N in the conveyance direction of the recording material P, an upstream lateral face of the film guide 105 is formed as a substantially arc shape along the rotating direction of the film 102, and maintains a uniform shape over the entire longitudinal direction. Also in the upstream side lateral face of the film guide 105, there is not provided a protruding portion extending toward the upstream side more than the upstream-side sliding face of the fixation flanges 108. Stated differently, the upstream-side lateral faces of the fixation flanges 108 have peripheral shapes which are positioned outside of and concentric with the upstream-side lateral face of the film guide 105.

Then, in the downstream side of nip portion N in the conveyance direction of the recording material P, a downstream lateral face of the film guide 105 has, in a most area thereof, a substantially arc shape symmetrical to the upstream-side lateral face, but a protruding portion 111 is provided, in a partial area at the downstream side of the pressurized nip N in the proximity of the center within the longitudinal direction. Such protruding portion 111 may be formed by a bulging structure integral with the film guide 105, or formed as a separate structure. In any case, the protruding portion 111 has a smooth convex shape which does not hinder the rotating movement of the film. The downstream-side lateral faces of the fixation flanges 108 have peripheral shapes which, except for the protruding portion 111, are positioned outside of and concentric with the downstream-side lateral face of the film guide 105, and, in the proximity of the protruding portion 111, the protruding face expands to the outside from the peripheral faces of the fixation flanges.

Also as shown in FIG. 6, the upper faces of the fixation flanges 108 have a height larger than that of the pressurizing stay 106.

Figure 7:
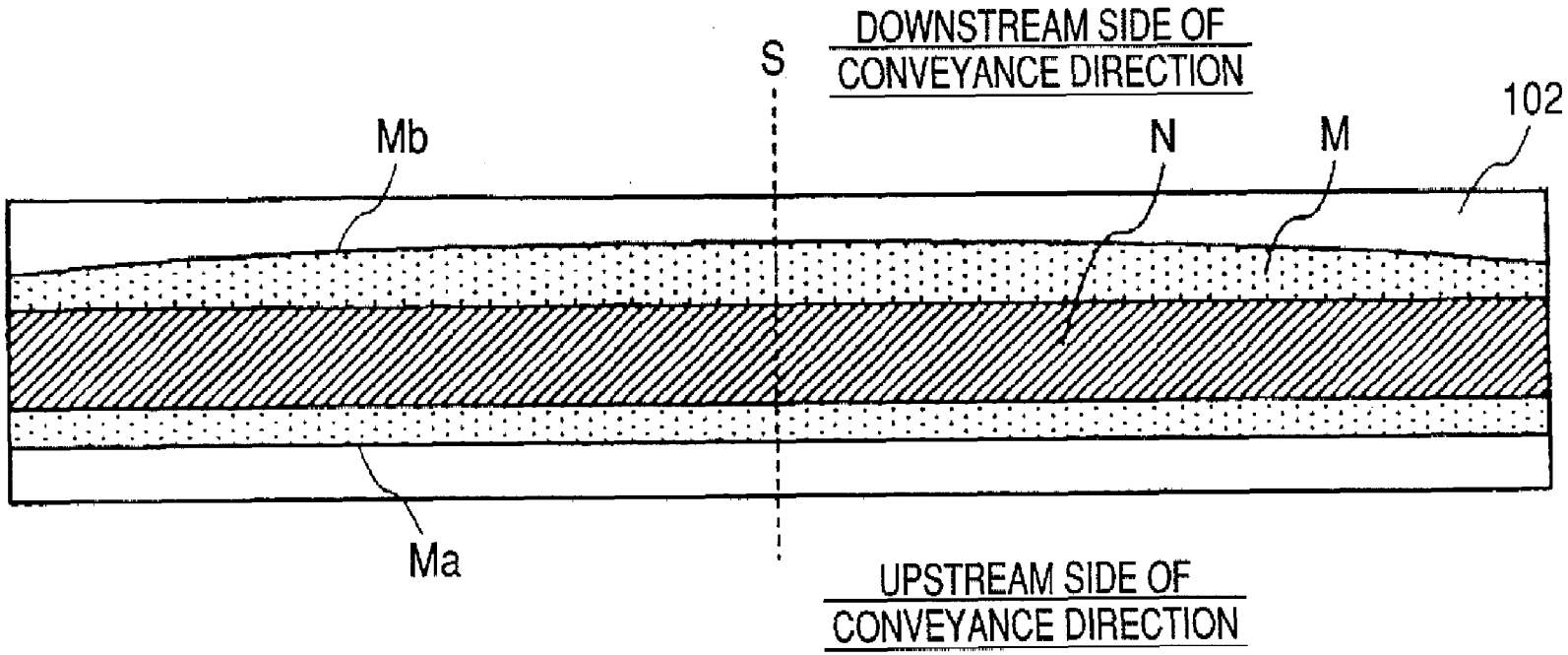
FIG. 7 is a schematic view of an embodiment of the heat fixing device of the present invention, seen from above.

FIG. 7 is a schematic view showing, in the heat fixing device 100 of the present embodiment, the pressurized nip N, the contact nip M and the film running state, as seen from above of the heat fixing device 100. As shown in FIG. 7, the upstream-side tangential line of the contact nip M, namely the entrance tangential line Ma of the recording material P has an almost flat shape along the longitudinal direction, while the downstream-side tangential line, namely the separating tangential line Mb of the recording material P has a substantially arc shape expanded toward the downstream side in the center of the longitudinal direction.

In the prior technology, the protruding portions for preventing paper creases are provided at least in such positions that the entrance tangential line Ma, at the upstream side in the conveyance direction, becomes concave toward the pressurized nip N in a central part of the longitudinal direction, and is extended toward the upstream side in external parts in the longitudinal direction. It is however found, by a preliminary investigation undertaken by the present inventors, that a paper crease preventing effect can be attained also by forming only the separating tangential line Mb, at the downstream side in the conveyance direction, in a substantially arc shape, as illustrated in the present embodiment. This indicates that a function of outwardly stretching the recording material P is present also in the downstream-side contact nip area from the exit of the pressurized nip N to the separating tangential line Mb. Stated differently, it is found that the paper crease preventing effect can be attained without unnecessarily extending, as in the prior technology, a part of the film 102 toward the upstream side from the nip portion N.

Then the present inventors have made following verifying experiments for investigating an optical running state of the fixing film 102 defined in the present embodiment. Items of verification have been selected as follows: "paper creases" in continuous passing of A3-sized sheets of a basis weight of 64 g/m$^2$, left standing in an environment of a high temperature and a high humidity; "a density loss in end portions" in a solid black image for same environment/paper; and "a slip" of the fixing film 102 when the paper passing is started from a cold state (unheated state of 50° C. or less) of the fixing apparatus for same environment/paper/image. The evaluations have been made in 3 levels of +/±/−, and criteria of evaluation for each item have been selected as follows:

Paper Creases

A rate of paper crease generation among continuously passed 100 sheets:

+: generation rate of 0%;

±: generation rate less than 10%;

−: generation rate of 10% or larger.

Density Loss in End Portions

A density difference, in density measurements with a reflective McBeth densitometer (RD914-; manufactured by a division of Kollmorgen Instrument Co.), defined as (average measured value in a central portion in the longitudinal direction)−(average measured value in left and right end portions):

+: density difference less than 0.1;

±: density difference equal to or larger than 0.1 but less than 0.2;

−: density difference 0.2 or larger.

Slip

A slip jam and a slip phenomenon (not reaching a jam) in the fixing film when continuous sheet passing is started from a cold state:

+: no slip phenomenon;

±: slip phenomenon observed but no slip jam;

−: slip jam observed.

Figure 8:
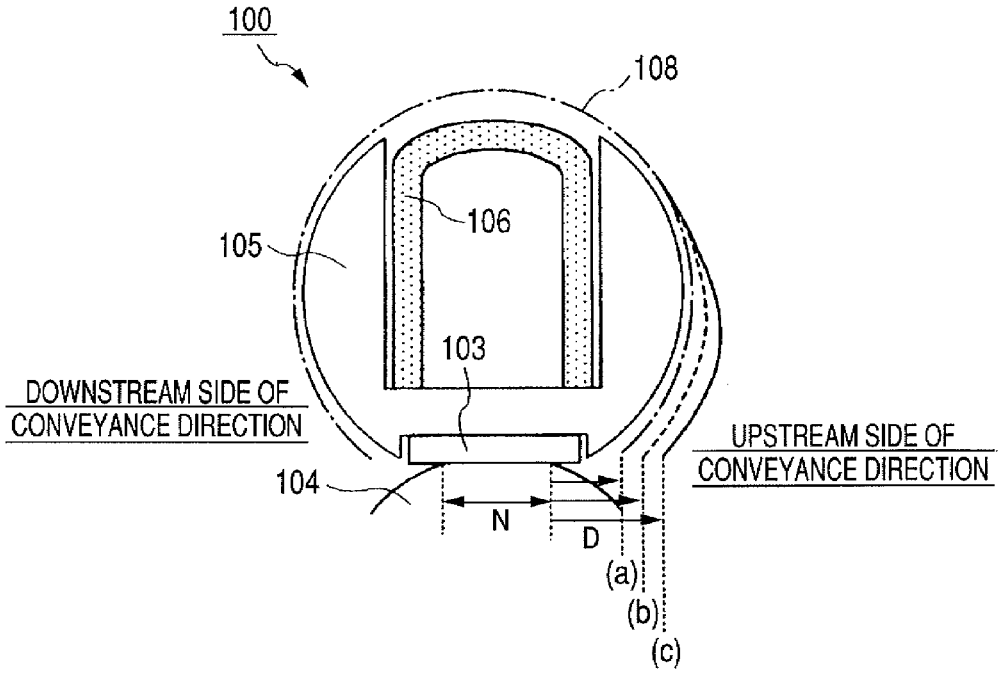
FIG. 8 is a cross-sectional view showing a schematic structure, for explaining, in the heat fixing device of the present invention, a bulging amount on a sliding face of the fixation flange at the upstream side in the conveyance direction.

At first, Table 1 shows results of evaluation when, in a film unit 101 without a protruding portion, a part of the upstream-side sliding face of the fixation flanges 108 is made to bulge as shown in FIG. 8 with different bulging amounts thereby stretching the end portions of the film 102, in the longitudinal direction thereof, toward the upstream side. Referring to FIG. 8, (a) indicates a case without a bulging (distance D=3 mm from the entrance tangential line Ma at the end portions in the longitudinal direction to the entrance of the pressurized nip N), (b) indicates a case with a bulging of level 1 (distance D=3.5 mm), and (c) indicates a case with a bulging of level 2 (distance D =4 mm).

TABLE 1

| | (a) | (b) | (c) |
|---|---|---|---|
| paper creases | − | ± | + |
| density loss in end portion | + | ± | − |
| slip | + | + | ± |

As shown in Table 1, even a mere bulging on the upstream-side sliding face of the fixation flanges 108 is effective against the paper creases. This is presumably because, by a bulging of the end portions of the fixation flanges 108, in the longitudinal direction thereof, toward the upstream side in the conveyance direction of the recording material, even when the film 102 becomes slack in the central portion in the longitudinal direction during the sheet-passing operation, a frequency of expansion of the central part in the longitudinal direction toward the upstream side, more than the end portions, decreases because of the bulging structure of the fixation flanges 108. However, the image density loss in the end areas in the width direction of the recording material and the slip of the fixing film were observed to be aggravated by the bulging structure of the fixation flanges 108. As to the image density loss in the end areas, the contact of the recording material P with the film 102 in front of the pressurized nip N facilitates perturbation of the unfixed image on the recording material P, thus promoting the background of the recording material P to be exposed more easily. Also the slip of the fixing film is caused by an increase in the film tension, by the bulging of the fixation flanges 108.

Among the three evaluation items, the distance D from the entrance tangential line Ma to the entrance of the pressurized nip N has a very large influence on the density loss in the end areas, so that the film running state of the present embodiment in the upstream side of the nip portion N, in the conveyance direction of the recording material, desirably has the distance D at 3.5 mm or less, preferably 3 mm or less as in the state (a), over the entire longitudinal direction.

Figure 9:
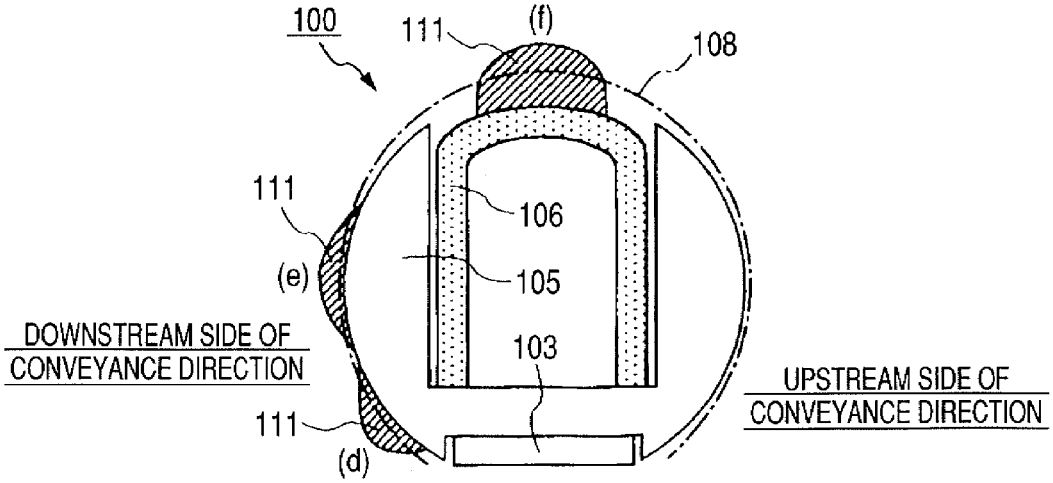
FIG. 9 is a schematic cross-sectional view showing, in the heat fixing device of the present invention, an arrangement of a protruding portion on a sliding face of the fixation flange.

Then, Table 2 shows results of evaluation on the position of the protruding portion 111 in the present embodiment, evaluated on positions shown in FIG. 9. In FIG. 9, (d) indicates a position which displaces the central portion of the film separating tangential line Mb, within the longitudinal direction, farther away from the pressurized nip N, while (e) indicates a position which is horizontally lateral to the lateral face of the film guide 105 at the downstream side thereof, and (f) indicates a position which is vertically above the upper face of the pressurizing stay 106. In any of these positions, an outward bulging amount from the sliding face of the fixation flanges 108 was selected as 1 mm. Also the upstream side in the conveyance direction had the structure (a) described above.

TABLE 2

| | (d) | (e) | (f) |
|---|---|---|---|
| paper creases | + | ± | ± |
| density loss in end portion | + | + | + |
| slip | + | + | + |

As shown in Table 2, the protruding portion 111 is preferably provided in a position such as (d). The positions (e) and (f) merely have a function of preventing a film slack during the passing operation of the recording materials P. On the other hand, the position (d) is assumed to attain the paper crease preventing function of the separating tangential line Mb as explained before, since it can maximize the curvature of the separating tangential line Mb while preventing the slack.

Figure 10:
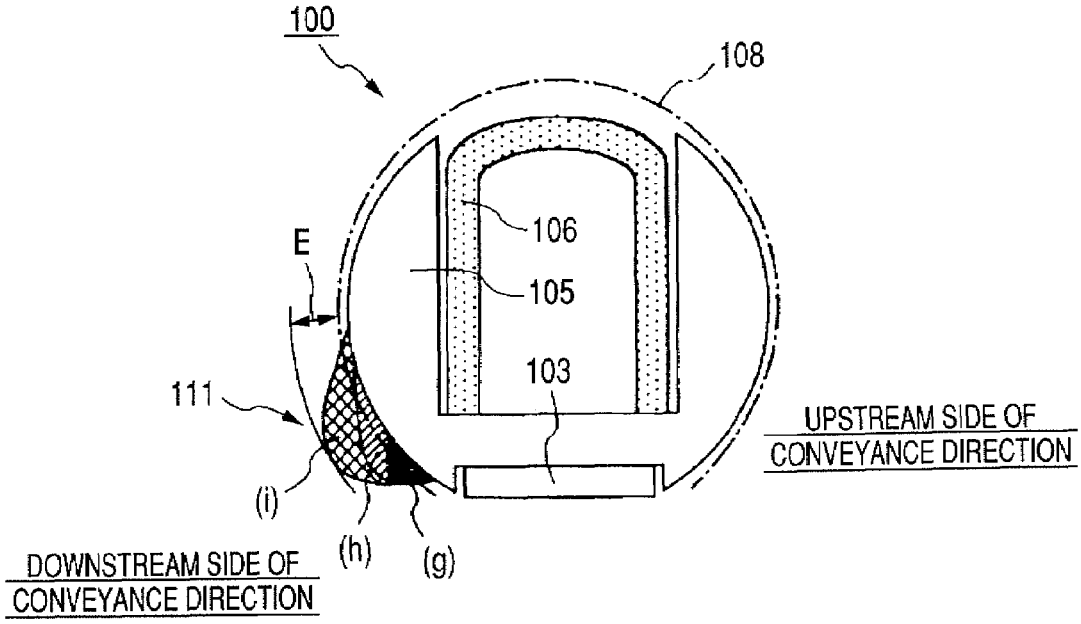
FIG. 10 is a schematic cross-sectional view showing, in the heat fixing device of the present invention, a convex amount of the protruding portion on the sliding face of the fixation flange.

Then, Table 3 shows results of evaluation, when an outward bulging amount E of the protruding portion 111 from the sliding face of the fixation flanges 108 is changed as shown in FIG. 10, wherein (g) indicates a case of E=0.3 mm, (h) indicates a case of E=1.0 mm, and (i) indicates a case of E=2.0 mm. The protruding portion 111 was provided in the position (d) above. Also the upstream side in the conveyance direction had the structure (a) described above.

TABLE 3

| | (g) | (h) | (i) |
|---|---|---|---|
| paper creases | ± | + | + |
| density loss in end portion | + | + | + |
| slip | + | + | ± |

As shown in Table 3, an excessively small protruding amount of the protruding portion 111 as in (g) results in little paper crease preventing effect, while an excessively large protruding amount as in (i) aggravates slip of the fixing film. As a result of detailed investigations undertaken by the present inventors on the curvature ρ of the substantially arc shape formed by the separating tangential line Mb for different protruding amounts of the protruding portion 111, it is found that a sufficient effect against the paper creases is obtained by ρ of 0.1/m or larger, while the slip of the fixing film is aggravated at 0.2/m or larger. Therefore, the curvature ρ of a curve, formed by connecting the separating positions between an arbitrary point on the recording material P and the film 102, along the longitudinal direction of the apparatus, is preferably within a range of $0.1 \leqq \rho \leqq 0.2$ (unit in 1/m).

Based on the results of three investigations above, it is found that the contact start line Ma and the contact end line Mb between the fixing film 102 and the recording material P preferably have shapes as shown in FIG. 7. More specifically, the distance D between the contact start position at which the fixing film 102 starts to contact with the recording material P, in the conveyance direction of the recording material, and the contact start position at which the fixing film 102 starts to contact with the drive roller 104, in the conveyance direction, is maintained at 3.5 mm or less over the longitudinal direction of the nip portion N (namely the distance between the line Ma and the entrance line for recording material of the nip portion N being 3.5 mm or less over the longitudinal direction), while the line Mb formed by connecting, along the longitudinal direction, the separating positions between the fixing film 102 and the recording material P in the conveyance direction, has a substantially arc shape which is most expanding in the conveyance direction at about the recording material conveyance reference position, within the longitudinal direction.

Now, Table 4 shows the results of comparative evaluation between a film unit structure having an optimum film running state of the present embodiment and prior structures. The prior structures used for comparison include following 3 structures:

Prior Example 1

Figure 18:
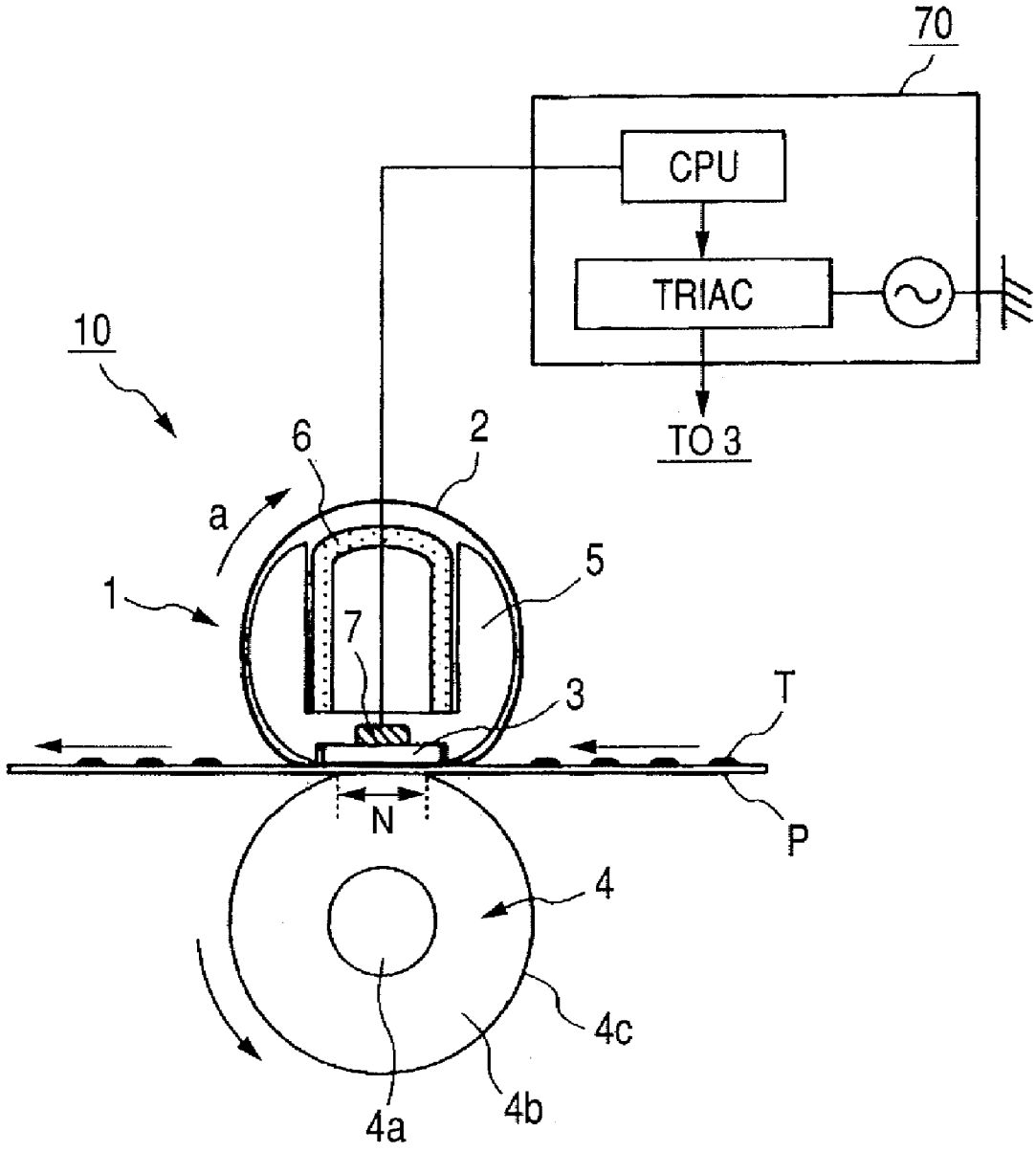
FIG. 18 is a cross-sectional view showing a schematic structure of a prior heat fixing device.
Figure 19:
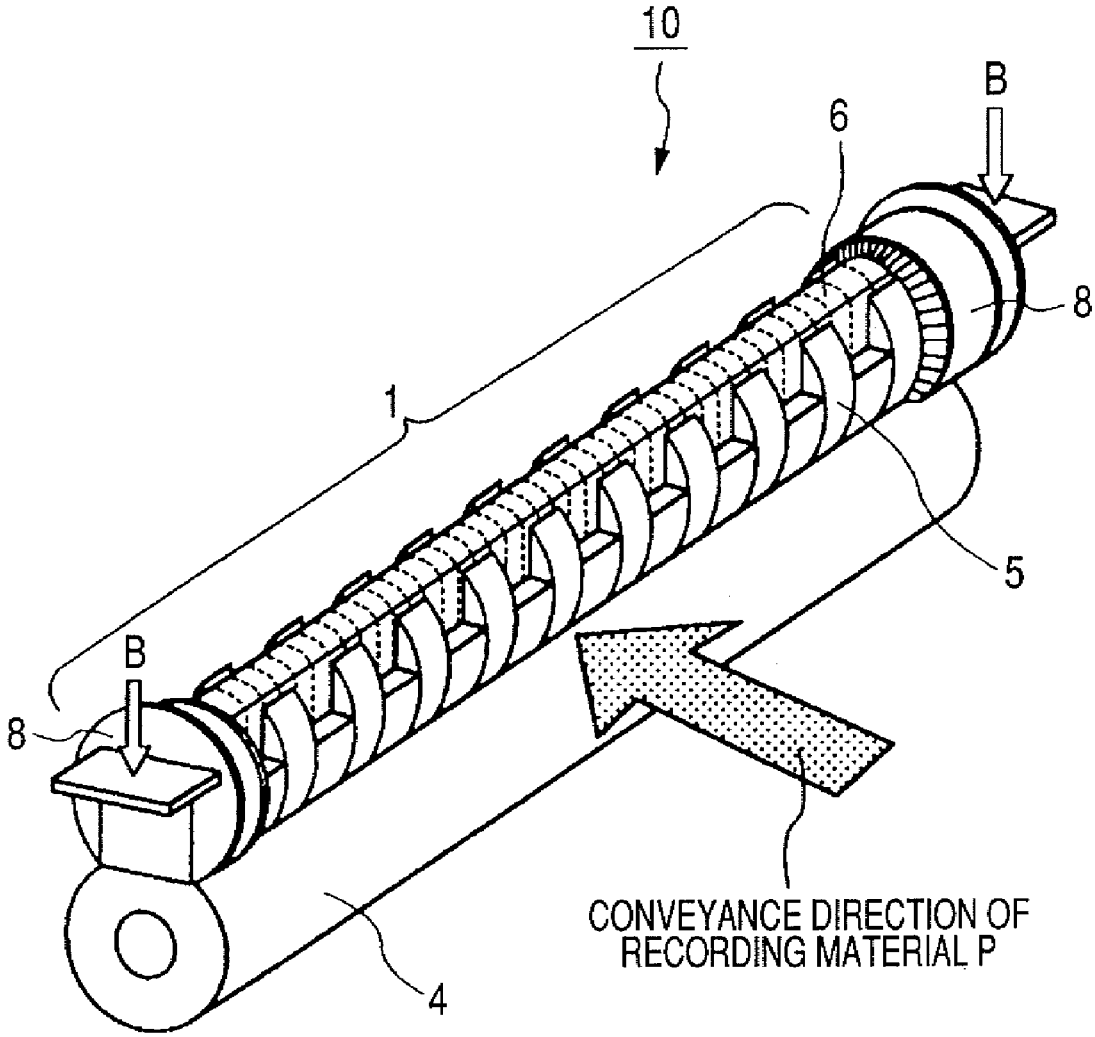
FIG. 19 is a perspective view showing a schematic structure of prior heat fixing device, seen from an upstream side in the conveyance direction of a recording material.

A fixing apparatus without a protruding portion, expanding outwards from the sliding face of the flanges, as shown in FIG. 18.

Prior Example 2

Figure 20:
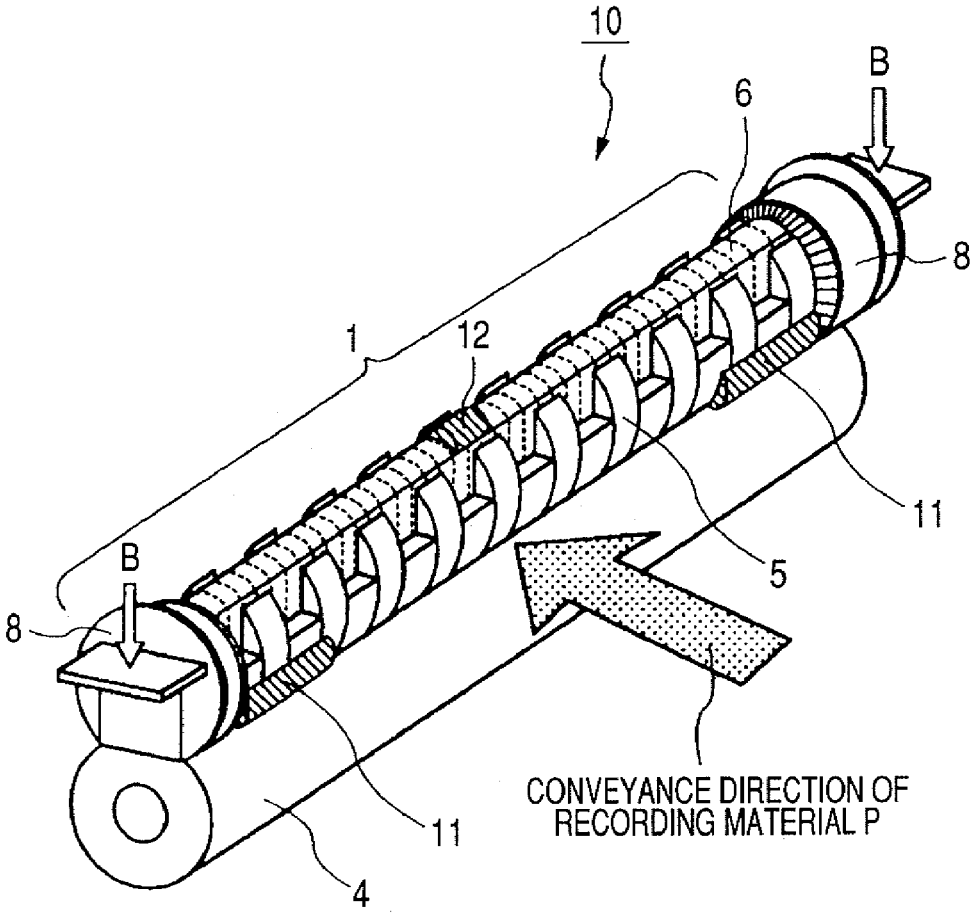
FIG. 20 is a perspective view showing a schematic structure of prior heat fixing device (heating fixing means described in Patent Reference 3), seen from an upstream side in the conveyance direction of a recording material.
Figure 21:
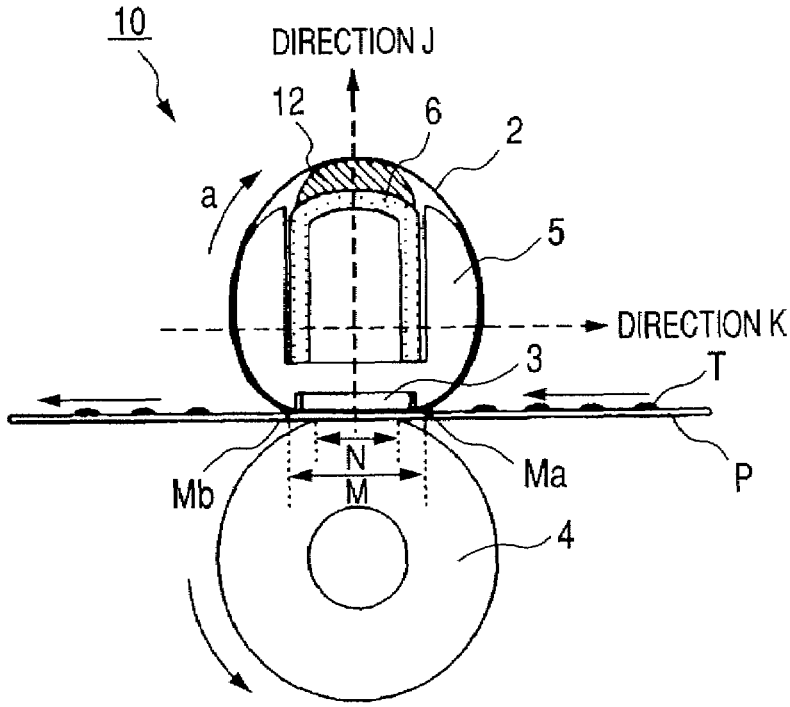
FIG. 21 is a cross-sectional view showing a schematic structure of the heat fixing device shown in FIG. 20.
Figure 22:
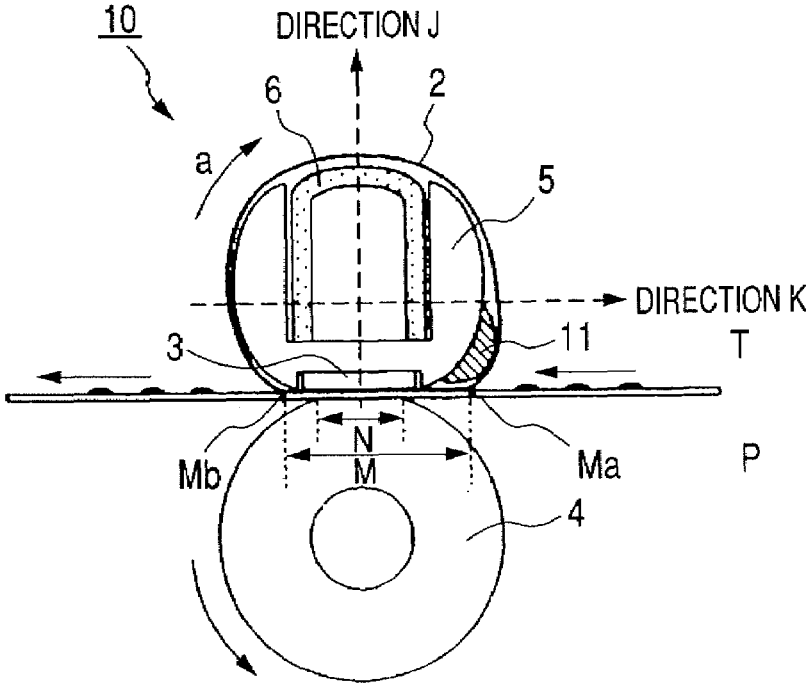
FIG. 22 is a cross-sectional view showing a schematic structure of the heat fixing device shown in FIG. 20.
Figure 23:
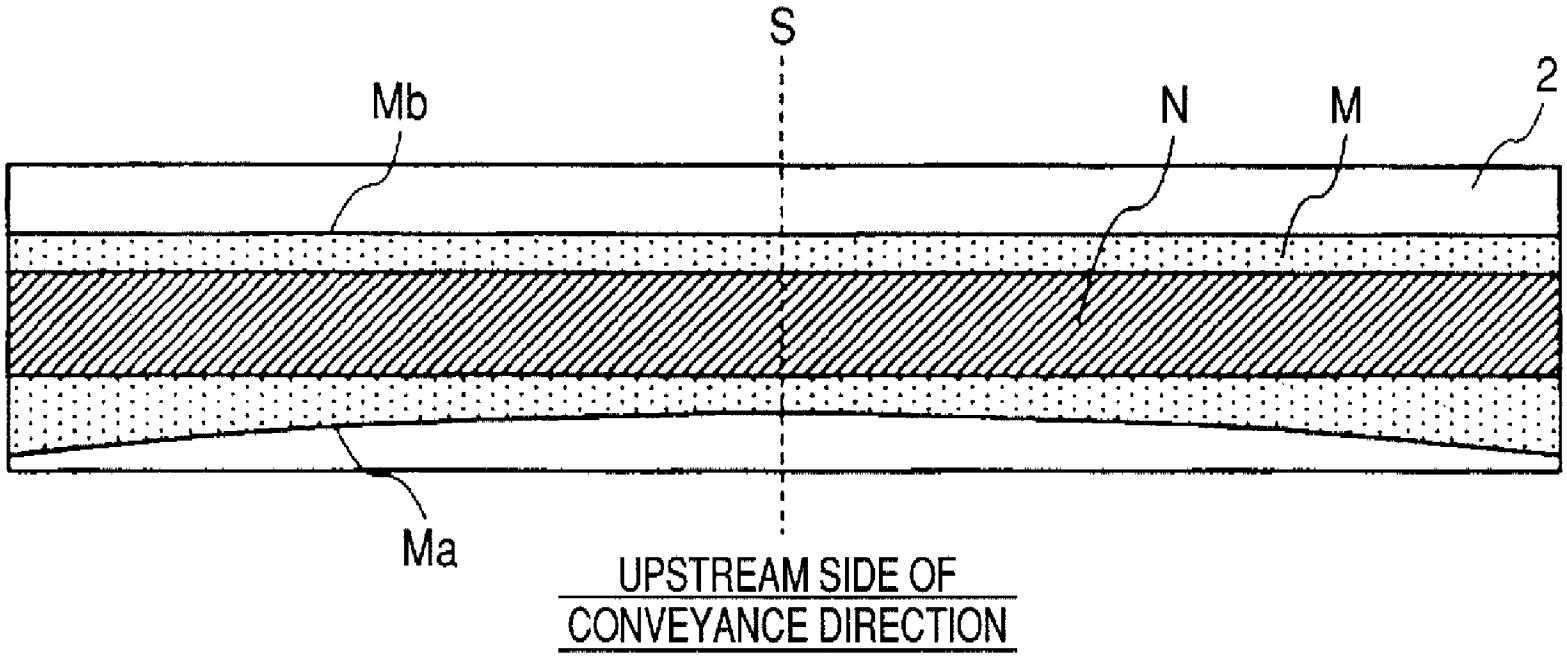
FIG. 23 is a schematic view, seen from above, of the heat fixing device shown in FIG. 20.

A fixing apparatus shown in FIG. 20.

Prior Example 3

Figure 24:
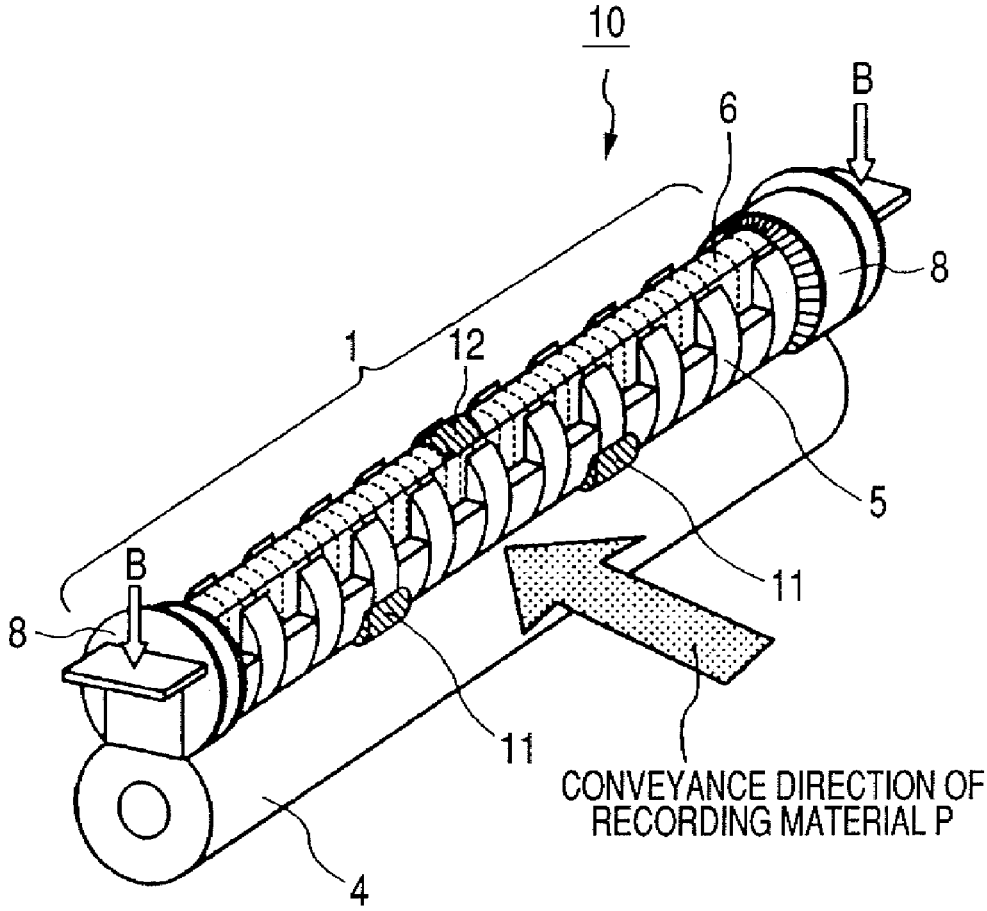
FIG. 24 is a perspective view showing a schematic structure of prior heat fixing device (heating fixing means described in Patent Reference 4), seen from an upstream side in the conveyance direction of a recording material.
Figure 25:
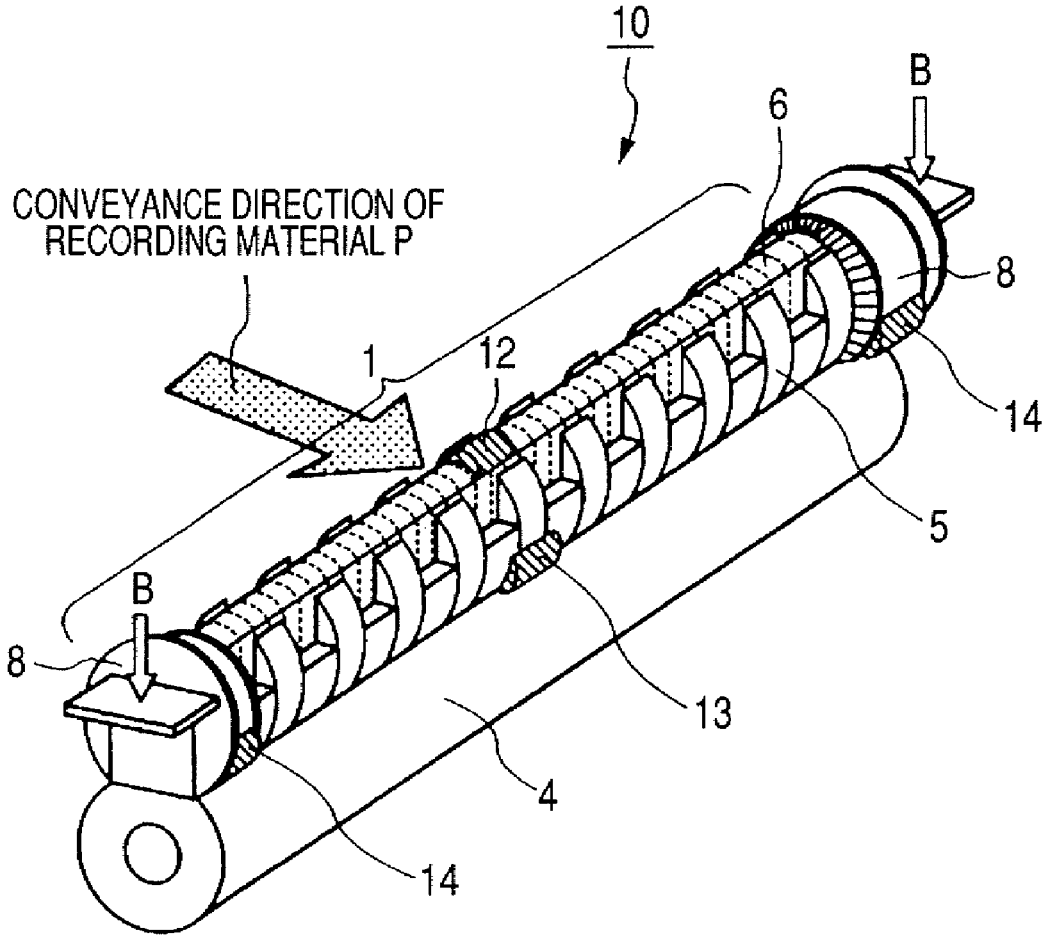
FIG. 25 is a perspective view showing a schematic structure of the prior heat fixing device shown in FIG. 24, seen from a downstream side in the conveyance direction of the recording material.
Figure 26:
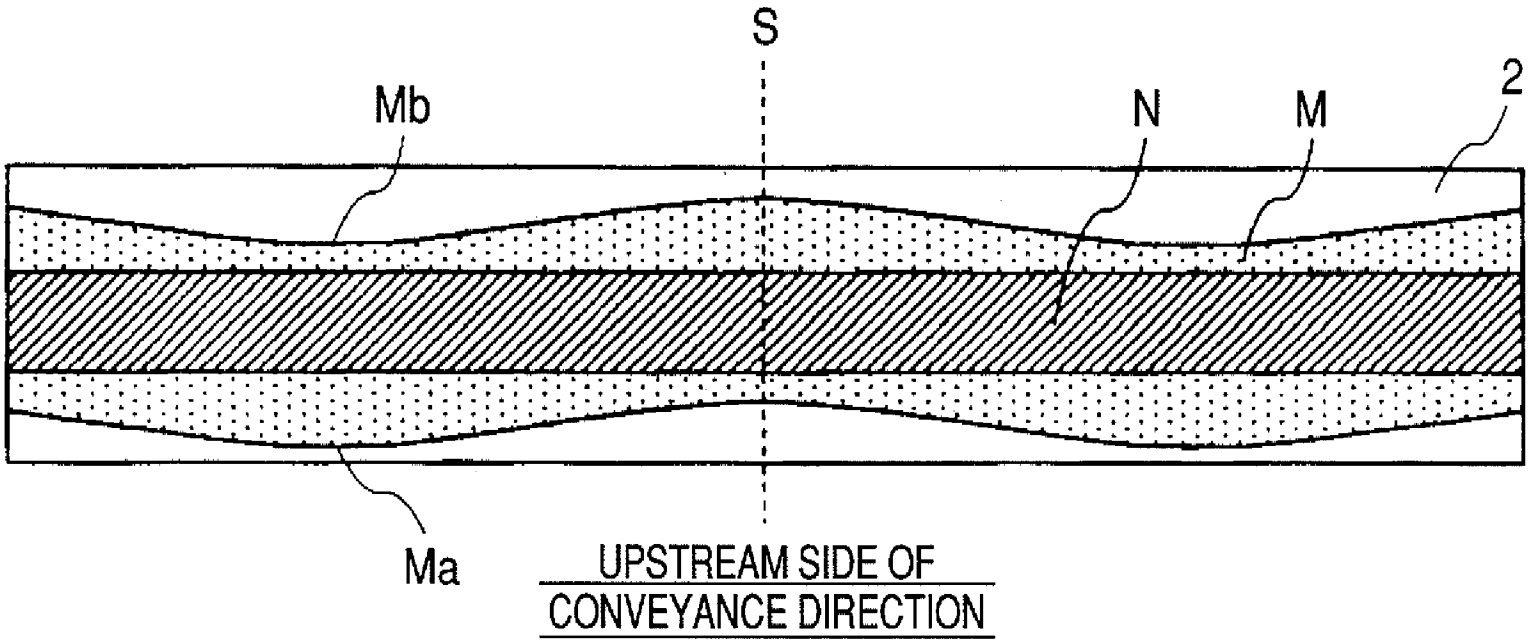
FIG. 26 is a schematic view, seen from above, of the heat fixing device shown in FIG. 24.

A fixing apparatus shown in FIG. 24.

TABLE 4

| | Embodiment 1 | Prior example 1 | Prior example 2 | Prior example 3 |
|---|---|---|---|---|
| paper creases | + | − | + | ± |
| density loss in end portion | + | + | − | ± |
| slip | + | + | + | ± |

As shown in Table 4, the prior example 1 is inferior in the paper creases, resulting from a slack of the film in the central part in the longitudinal direction. The prior example 2 is inferior in the density loss in the end portions, resulting from an excessive expansion, toward the upstream side, of the film in the end portions within the longitudinal direction. Also the prior example 3 is insufficient in satisfying the paper creases and the density loss in the end portions at the same time, and shows an aggravated slip due to an excessive film tension. On the other hand, the embodiment 1 is capable of maintaining these 3 items at a satisfactory level.

The present embodiment, as described above, allows to achieve a film running state capable of preventing paper creases without unnecessarily expanding the upstream side of the film unit 101, in the conveyance direction. It is therefore possible to suppress the image perturbation such as the density loss in the end portions, and to suppress the paper creases at the same time. Also the protruding portion 111 to be provided in the members of the film unit can be minimized, thereby suppressing the slip of the fixing film.

In the embodiment 1, there has been explained a case where the position of the protruding portion 111 in the longitudinal direction is limited to an area including the center of the longitudinal direction, which is a recording material conveyance reference position. However, such structure is not restrictive, and there may be employed any protruding portion that the convex amount of the separating tangential line Mb of the film, in the conveyance direction of the recording material, is largest at the center in the longitudinal direction and becomes gradually smaller toward the both end portions. For example, a similar effect can be obtained by forming plural protruding portions in somewhat distant positions, substantially symmetrical to the recording material conveyance reference position.

Embodiment 2

Figure 11:
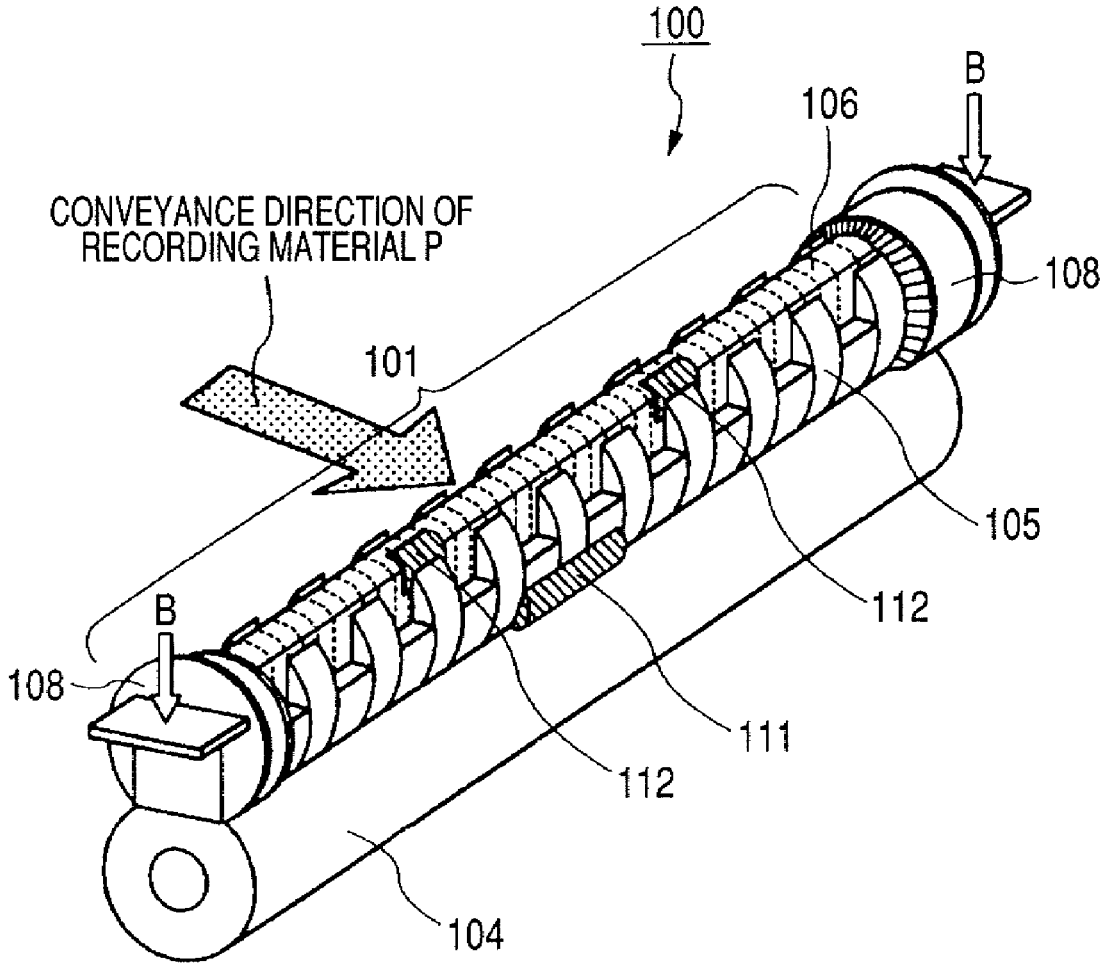
FIG. 11 is a perspective view showing a schematic structure of another embodiment of the heat fixing device of the present invention, seen from a downstream side in the conveyance direction of the recording material.
Figure 12:
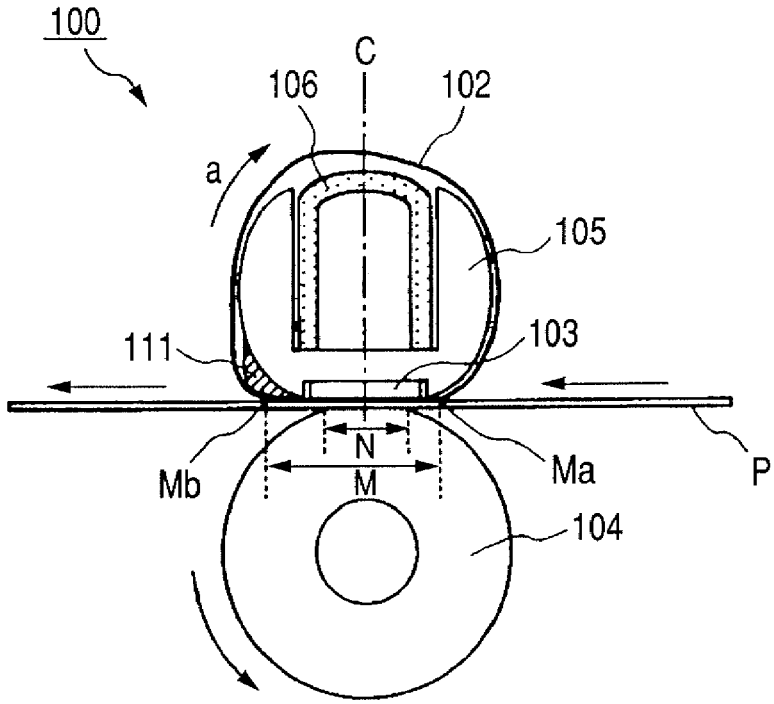
FIG. 12 is a cross-sectional view showing a schematic structure of another embodiment of the heat fixing device of the present invention.
Figure 13:
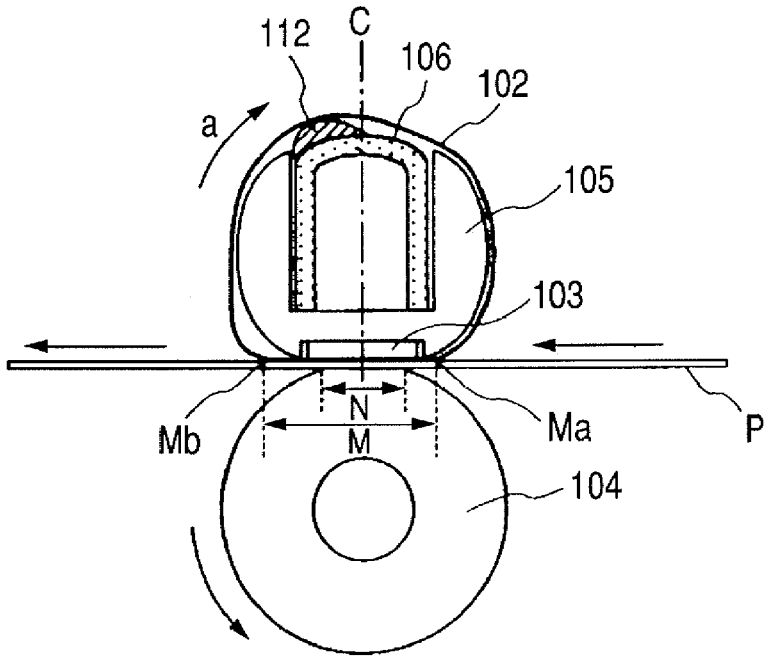
FIG. 13 is a cross-sectional view showing a schematic structure of another embodiment of the heat fixing device of the present invention.
Figure 14:
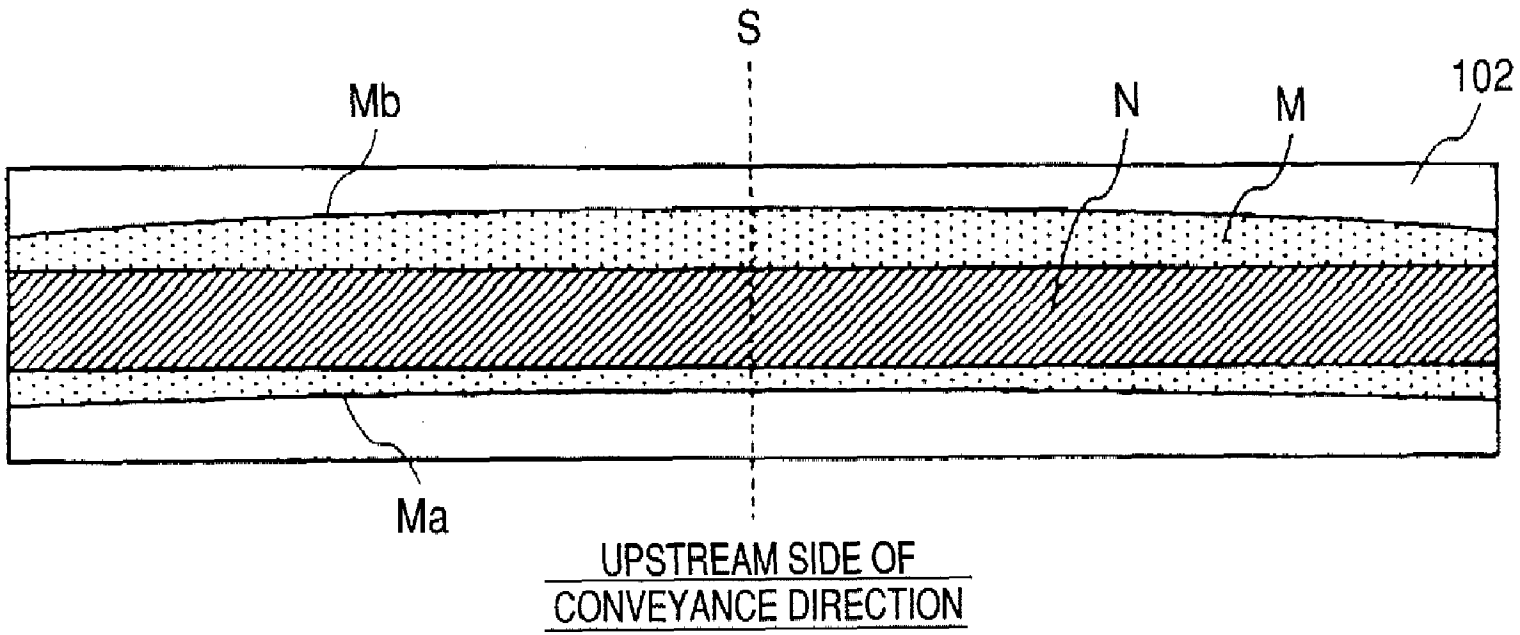
FIG. 14 is a view, seen from above, showing a schematic structure of another embodiment of the heat fixing device of the present invention.

Now a second embodiment of the present invention will be explained with reference to FIGS. 11 to 14. FIG. 11 is a perspective view of heat fixing device 100 of the present embodiment, seen from a downstream side in the conveying direction of a recording material P, in which a fixing film 102 is omitted. FIG. 12 is a schematic cross-sectional view of the heat fixing device 100 of the present embodiment, at a position where a protruding portion 111 is formed. FIG. 13 is a schematic cross-sectional view of the heat fixing device 100 of the present embodiment, at a position where a protruding portion 112 is formed. FIG. 14 is a schematic view showing a pressurized nip N, a contact nip M and a film running state in the heat fixing device 100 of the present embodiment, seen from above the upper face of the heat fixing device 100.

The heat fixing device 100 of the present embodiment has a structure similar to that of the heat fixing device 100 of the embodiment 1, but is characterized in following structures. The present embodiment has, in addition to the structure of the film unit 101 of the embodiment 1, firstly a structure having a protruding portion 112 on an upper face of the pressurizing stay 106, in a downstream area with respect to a center line passing through a center of the upstream and downstream sides of the pressurized nip N, namely with respect to a vertical plane C passing through the up-/downstream center line. Secondly, in the present embodiment, the protruding portion 111 and the protruding portion 112 are not formed on a same cross section of the heat fixing device 100, but the protruding portion 111 and the protruding portion 112 are formed in positions in mutually displaced along the longitudinal direction.

In the present embodiment, the first structure described above allows, while maintaining the separating tangential line Mb at the downstream side in the conveyance direction in a substantially arc shape, to form the film entrance tangential line Ma at the upstream side in the conveyance direction in a concave shape toward the pressurized nip, thereby forming the entrance tangential line Ma also in a substantially arc shape. It is therefore possible to increase the paper crease preventing effect without aggravating the density loss in the end portions. Stated differently, it is possible to increase margins against the paper creases and the density loss in the end portions. However, also in the present embodiment, the distance D between the contact start position at which the fixing film 102 starts to contact with the recording material P, in the conveyance direction of the recording material, and the contact start position at which the fixing film 102 starts to contact with the drive roller 104, in the conveyance direction, is maintained at 3.5 mm or less over the longitudinal direction of the nip portion N, while the line Mb formed by connecting, along the longitudinal direction, the separating positions between the fixing film 102 and the recording material P in the conveyance direction, has a substantially arc shape which is most expanding in the conveyance direction at about the recording material conveyance reference position, within the longitudinal direction.

Also the second structure described above allows to prevent an excessive increase in the film tension caused by providing plural protruding portions on a same cross section, thereby avoiding an aggravated slip.

The film unit structure as in the present embodiment 2 allows to further increase margins against the paper creases, image perturbation and slip which are the targets of the present invention.

Embodiment 3

Figure 15:
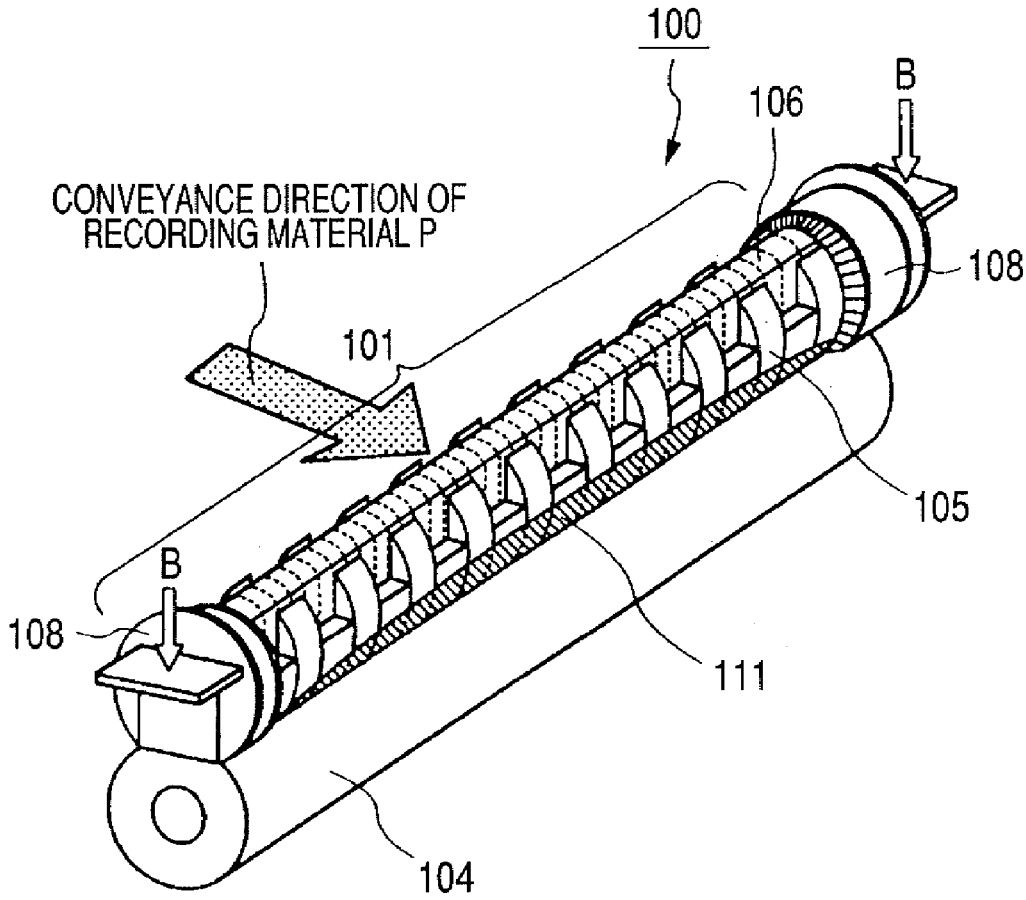
FIG. 15 is a perspective view showing a schematic structure of another embodiment of the heat fixing device of the present invention, seen from the downstream side in the conveyance direction of the recording material.

Now a third embodiment of the present invention will be explained with reference to FIG. 15. FIG. 15 is a perspective view of heat fixing device 100 of the present embodiment, seen from a downstream side in the conveying direction of a recording material P, in which a fixing film 102 is omitted.

The heat fixing device 100 of the present embodiment has a structure similar to that of the heat fixing device 100 of the embodiments 1 and 2, but is characterized in following structures.

In contrast to the embodiments 1 and 2 in which the protruding portions 111 are locally provided along the longitudinal direction, the present embodiment is provided with a protruding portion 111 which is continuous or is divided in plural portions over the entire longitudinal direction, with such a convex amount as to form a gradual substantially arc shape from the center in the longitudinal direction.

The film unit structure of the present embodiment allows to disperse a film tension, applied to the protruding portion 111, over the longitudinal direction, thereby alleviating the rotational load of the film 102. Also the rotational movement of the film 102 is stabilized to reduce a frequency of fluctuation of the film contact nip M on the recording material P during the rotational movement, thereby achieving further improvements on the paper creases and the image perturbation.

Embodiment 4

In the following, a fourth embodiment of the present invention will be explained with reference to FIGS. 16A, 16B and 17. In contrast to the embodiments 1 to 3 which have explained heat fixing device in which a recording material conveyance reference position for the recording material P is provided at the center in the longitudinal direction, the present embodiment 4 provides a heating apparatus in which a recording material conveyance reference position is provided at an end in the longitudinal direction.

Figure 16A:
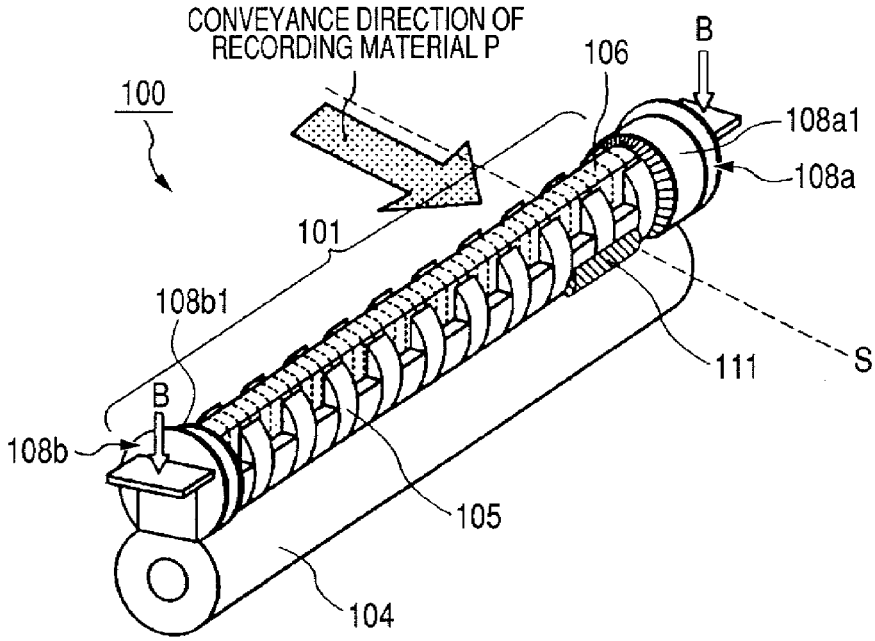
FIG. 16A is a perspective view showing a schematic structure of another embodiment of the heat fixing device of the present invention, seen from the downstream side in the conveyance direction of the recording material.

FIG. 16A is a perspective view of heat fixing device 100 of the present embodiment 4, seen from a downstream side in the conveying direction of a recording material P, in which a fixing film 102 is omitted. FIG. 16B is a lateral cross-sectional view. FIG. 17 is a schematic view showing a pressurized nip N, a contact nip M and a film running state in the present embodiment, seen from above the upper face of the heat fixing device 100. A reference line S for recording material conveyance is provided in the proximity of an end of the heat fixing device in the longitudinal direction, and a protruding portion 111 according to the present embodiment is provided in the proximity of the recording material conveyance reference line S.

The heat fixing device 100 of the present embodiment has a structure similar to that of the heat fixing device 100 of the foregoing embodiments, but is characterized in following structures.

Figure 16B:
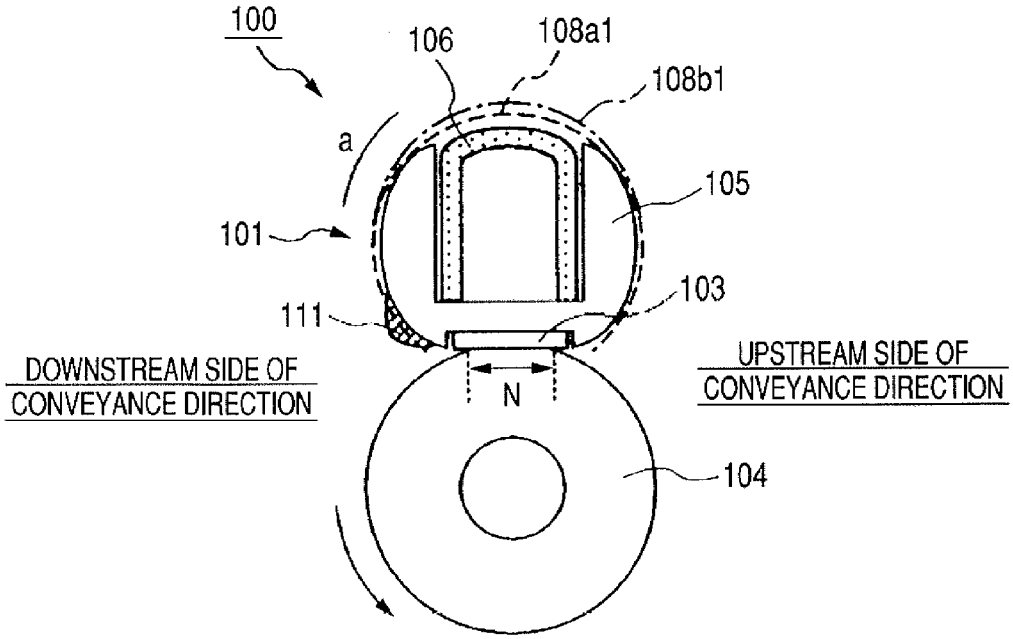
FIG. 16B is a cross-sectional view showing a schematic structure of another embodiment of the heat fixing device of the present invention, seen in the longitudinal direction.
Figure 17:
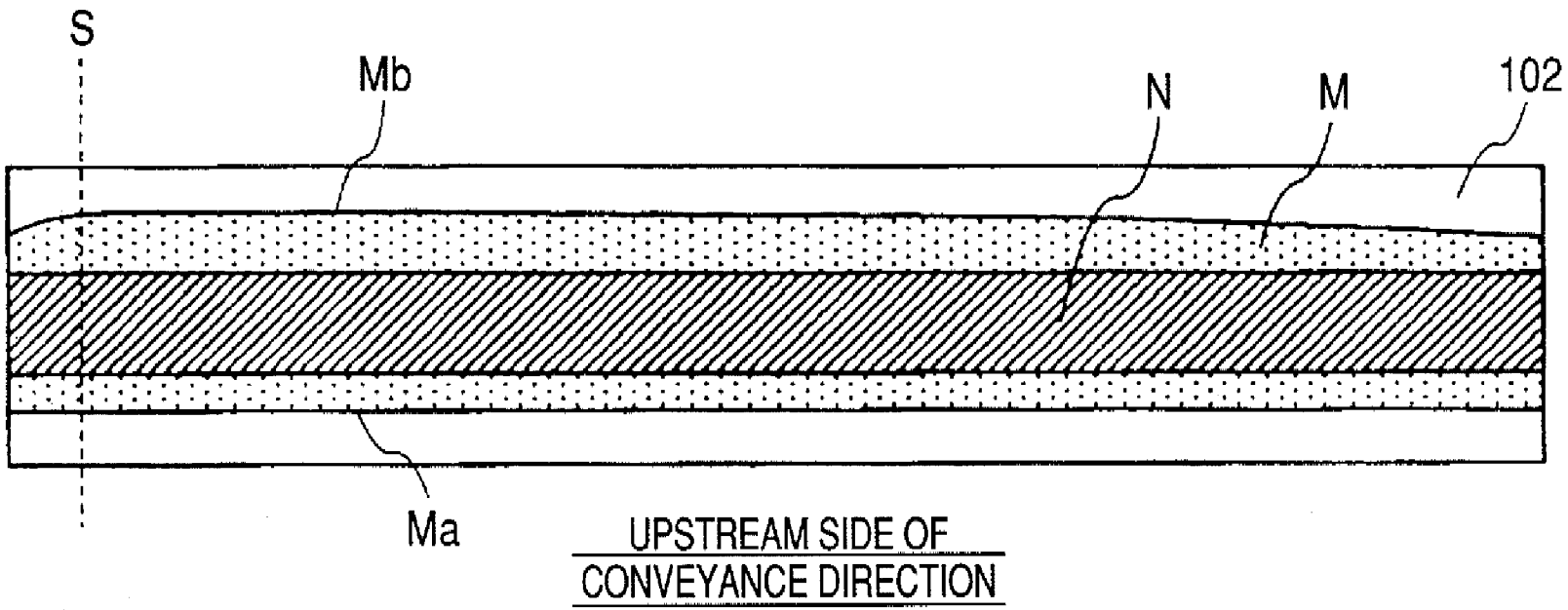
FIG. 17 is a schematic view of another embodiment of the heat fixing device of the present invention, seen from above.

In the present embodiment, as shown in FIG. 16B, the sliding face 108*a*1 of the fixation flange 108*a* at the side of the recording material conveyance reference position has a height of the upper face, lower than the height of the sliding face 108*b*1 of the fixation flange 108*b* at the opposite side. Such structure allows to obtain a film running state and effects similar to those in other embodiments, even in a fixing apparatus having the reference position at an end position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-271019, filed Sep. 16, 2005, which is hereby incorporated by reference herein in its entirety.

What is claimed is:

1. An image heating apparatus comprising:

a cylindrical film;

a heating member which contacts an internal periphery of said cylindrical film; and a drive roller which forms a nip portion with said heating member through the cylindrical film;

wherein a recording material bearing an image is heated while the recording material is nipped and conveyed by the nip portion, and wherein a distance between a position at which said film starts contacting with the recording material in a conveyance direction of the recording material and a position at which said film starts contacting with the drive roller in the conveyance direction of the recording material is equal to or less than 3.5 mm over a longitudinal direction of the nip portion, and a line formed by connecting positions at which said film is separated from the recording material in the conveyance direction has a substantially arc shape which is most expanded to a downstream side of the conveyance direction in a proximity of a recording material conveyance reference in the longitudinal direction of the nip portion.

2. An image heating apparatus according to claim 1, wherein the distance between the position at which said film starts contacting with the recording material in the conveyance direction of the recording material and the position at which said film starts contacting with said drive roller in the conveyance direction of the recording material is 3 mm or less.

3. An image heating apparatus according to claim 1, wherein a curvature ρ of the line formed by connecting positions at which said film is separated from the recording material in the conveyance direction is within a range of $0.1(1/m) \leqq \rho \leqq 0.2(1/m)$.

4. An image heating apparatus according to claim 2, wherein a curvature ρ of the line formed by connecting positions at which said film is separated from the recording material in the conveyance direction is within a range of $0.1(1/m) \leqq \rho \leqq 0.2(1/m)$.

5. An image heating apparatus according to claim 1, comprising a heating member support member provided at an internal peripheral side of said film, the heating member support member supporting said heating member over the longitudinal direction, wherein a protruding portion which contacts with the internal peripheral surface of said film so as to form the substantially arc shape of the line is provided only in a part of the heating member support member, the part is at a downstream side of the nip portion in the conveyance direction and in a proximity of the recording material conveyance reference.

* * * * *